US008727492B2

(12) United States Patent
Mihara et al.

(10) Patent No.: US 8,727,492 B2
(45) Date of Patent: May 20, 2014

(54) IMAGE FORMING APPARATUS MANAGING A WASTE LIQUID TANK

(75) Inventors: Yasumasa Mihara, Kanagawa (JP); Seiichi Kogure, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 537 days.

(21) Appl. No.: 12/552,478

(22) Filed: Sep. 2, 2009

(65) Prior Publication Data

US 2010/0067934 A1 Mar. 18, 2010

(30) Foreign Application Priority Data

Sep. 17, 2008 (JP) ..... 2008-237420

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS

| | | | | |
|---|---|---|---|---|
| 4,965,596 | A * | 10/1990 | Nagoshi et al. | 347/36 |
| 7,195,332 | B2 * | 3/2007 | Akase et al. | 347/23 |
| 7,222,935 | B2 * | 5/2007 | Ono | 347/36 |
| 7,334,858 | B2 | 2/2008 | Kogure et al. | |
| 7,393,092 | B2 * | 7/2008 | Saruta et al. | 347/86 |
| 2002/0180820 | A1 | 12/2002 | Tsuruoka | |
| 2005/0185035 | A1 | 8/2005 | Takei | |
| 2006/0232645 | A1 | 10/2006 | Kumagai et al. | |
| 2007/0103532 | A1 | 5/2007 | Imoto et al. | |
| 2007/0109385 | A1 | 5/2007 | Imoto et al. | |
| 2008/0043083 | A1 | 2/2008 | Imoto et al. | |
| 2008/0106566 | A1 | 5/2008 | Kogure et al. | |
| 2009/0058911 | A1 | 3/2009 | Kogure et al. | |

FOREIGN PATENT DOCUMENTS

| | | |
|---|---|---|
| JP | 07-309018 | 11/1995 |
| JP | 11-192725 | 7/1999 |
| JP | 2002-029065 | 1/2002 |
| JP | 2002-331685 | 11/2002 |
| JP | 2005-066981 | 3/2005 |
| JP | 2005-088419 | 4/2005 |
| JP | 2005-238832 | 9/2005 |
| JP | 2006-306041 | 11/2006 |
| JP | 2006-306042 | 11/2006 |
| JP | 2007-098777 | 4/2007 |

OTHER PUBLICATIONS

Japanese Office Action dated Oct. 24, 2012.

* cited by examiner

*Primary Examiner* — Alejandro Valencia
(74) *Attorney, Agent, or Firm* — IPUSA, PLLC

(57) ABSTRACT

An image forming apparatus includes an image forming part to form an image by injecting a liquid. A waste liquid tank is detachably attached to the image forming apparatus to store a waste liquid discharged from the image forming part. The waste liquid tank has a memory element to store identification information A and waste liquid amount information B. A memory unit stores identification information C and waste liquid amount information D. A control unit determines a current amount of the waste liquid currently retained in the waste liquid tank at a predetermined timing in accordance with the identification information A and the waste liquid amount information B stored in the memory element and the identification information C and the waste liquid amount information D stored in the memory unit, and updates the current amount of the waste liquid in accordance with a subsequent operation of the image forming part.

13 Claims, 19 Drawing Sheets

FIG.19 xxx@xxx.xxx.xx
2008/03/26 16:19

Address: xxx@yy.co.jp

Cc:

Re: Device Alert Notification: replace ink recovery unit soon

Printer:
replace ink recovery unit soon
Detail Information:
replace ink recovery unit soon
---

Model Name:
Comment:
TCP/IP(Ethernet)
Host Name: SAMPLE
IPv4 Address: 111.111.111.111
Physical Address: 00:00:AA:AA:AA:AA
Domain Name:
Device Status Display
(Ethernet) : http://111.111.111.111/index.html

IMAGE FORMING APPARATUS MANAGING A WASTE LIQUID TANK

BACKGROUND OF THE INVENTION

1. Field of the Invention

The present invention relates to an image forming apparatus using a liquid as a recording material.

2. Description of the Related Art

For example, an inkjet recording apparatus is used in an image forming apparatus such as a printer, a facsimile machine, a copy machine, a multi-function peripheral machine, etc. The inkjet recording apparatus records or forms an image on a recording medium such as a recording paper by injecting droplets of ink as a recording liquid onto the recording paper. The recording medium on which an image is recorded by the inkjet recording apparatus may include various materials such as a recording paper, a transfer paper, a transfer material, a recording material (a material on which recording is performed), etc. Recording by the inkjet recording apparatus may be used in the same meaning as image forming, picture printing, character printing, image printing, etc.

The inkjet recording apparatus normally has a problem in that a recording error occurs due to malfunctioning of a recording head, which injects droplets of ink pressurized in a pressurizing chamber from a nozzle onto a recording paper. The recording error occurs in the recording head due to an increase in a viscosity of ink, solidification of ink, adhesion of dusts, interfusion of bubbles in ink, etc. An increase in ink viscosity and solidification of ink occur due to evaporation of solvent contained in ink at the nozzle.

In order to prevent such a problem associated with the recording head, a cap member is provided to the recording head in order to seal the nozzle when recording is not performed. A wiping member may also be provided to clean a nozzle formation surface. Further, a dummy recording discharge receiver may be provided to receive discharged droplets of ink, which do not contribute to recording. The cap member does not only serve as a lid of the nozzle to prevent desiccation of ink but also serves as a suction member to suction the nozzle. That is, the cap member seals the nozzle formation surface and pulls ink out of the nozzle by using a negative pressure introduced by a suction pump in order to eliminate clogging of the nozzle.

The forcible ink suctioning process to eliminate clogging in the recording head is referred to as a cleaning operation or maintenance. The cleaning operation is carried out when restarting a recording operation after a long time stop period of the inkjet recording apparatus. The cleaning operation may be performed at a predetermined time interval during a recording operation. The cleaning operation can be performed by operating a cleaning switch when a user finds malfunctioning of the recording head. The cleaning operation may also be performed at the time of replacing a cartridge. In the cleaning operation, ink is pulled out of the recording head, and, thereafter, the nozzle formation surface (a surface forming the nozzle) of the recording head is wiped by a wiping member made of an elastic material such as rubber. Additionally, during a recording operation, a dummy recording discharge is performed at a desired timing.

A waste liquid (waste ink) ejected from the recording head into the cap member is stored in a waste liquid tank by being moved by a suction pump. Generally, a porous material is accommodated in the waste liquid tank to retain the waste liquid by being absorbed by the porous material.

The waste liquid tank accommodating the waste liquid absorbing material has a capacity to retain an entire amount of waste liquid generated during a service life of the recording apparatus. Accordingly, a relatively large capacity is required for the waste liquid tank, and such a waste liquid tank is arranged, for example, at a bottom of the recording apparatus while occupying a large area of the bottom. Thus, there is a problem in that the waste liquid tank may limit a miniaturization of the recording apparatus.

Thus, there is suggested an image forming apparatus equipped with a replaceable waste liquid tank (for example, refer to Patent Document 1). Additionally, there is suggested a liquid injection apparatus having means for memorizing an amount of liquid discharged into a waste liquid recovery container, wherein the memory is reset when the waste liquid in the waste liquid recovery container is collected to a waste liquid tank (for example, refer to Patent Document 2).

Patent Document 1: Japanese Laid-Open Patent Application No. 2005-088419

Patent Document 2: Japanese Laid-Open Patent Application No. 2006-306042

Patent Document 2 discloses management of an amount of waste liquid using a memory for storing information of an amount of waste liquid. Thus, even if one applies the technique of Patent Document 2 to the technique of Patent Document 1 to make the waste liquid tank replaceable, an accurate amount of waste liquid retained in the waste liquid tank cannot be known if the waste liquid tank has been replaced by a used waste liquid tank, which raises a problem that the waste liquid tank is filled up and the waste liquid may overflow.

SUMMARY OF THE INVENTION

It is a general object of the present invention to provide an image forming apparatus in which the above-mentioned problems are eliminated.

A more specific object of the present invention is to provide an image forming apparatus, which accurately manages an amount of waste liquid currently stored in a waste liquid tank under any circumstances.

In order to achieve the object, there is provided according to one aspect of the present invention an image forming apparatus comprising: an image forming part configured and arranged to form an image by injecting a liquid; a waste liquid tank detachably attached to the image forming apparatus and configured and arranged to store a waste liquid discharged from the image forming part, the waste liquid tank having a memory element to store identification information A and waste liquid amount information B of the liquid tank; a memory unit that stores identification information C and waste liquid amount information D of the waste liquid tank; and a control unit that manages information regarding the waste liquid tank, wherein the control unit determines a current amount of the waste liquid currently retained in the waste liquid tank at a predetermined timing in accordance with the identification information A and the waste liquid amount information B stored in the memory element and the identification information C and the waste liquid amount information D stored in the memory unit, and updates the current amount of the waste liquid in accordance with a subsequent operation of the image forming part.

There is provided according to another aspect of the present invention a waste liquid management method performed in an image forming apparatus including: an image forming part configured and arranged to form an image by injecting a liquid; a waste liquid tank detachably attached to the image forming apparatus and configured and arranged to store a waste liquid discharged from the image forming part, the waste liquid tank having a memory element to store identification information A and waste liquid amount information B of the liquid tank; and a memory unit that stores identification information C and waste liquid amount information D of the waste liquid tank, the waste liquid management method comprising: determining a current amount of the waste liquid currently retained in the waste liquid tank at a predetermined timing in accordance with the identification information A and the waste liquid amount information B stored in the memory element and the identification information C and the waste liquid amount information D stored in the memory unit; and updating the current amount of the waste liquid in accordance with a subsequent operation of the image forming part.

There is provided according to a further aspect of the present invention a computer readable recording medium storing a program to cause a computer to perform the above-mentioned waste liquid management method.

According to the present invention, the waste liquid tank is provided with the memory element, which stores information indicating an amount of the waste liquid stored in the waste liquid tank. Thus, the current amount of the waste liquid currently stored in the waste liquid tank can be managed accurately even when a used waste liquid tank, which already stores some amount of the waste liquid, is attached to the image forming apparatus.

Other objects, features and advantages of the present invention will become more apparent from the following detailed description when read in conjunction with the accompanying drawings.

BRIEF DESCRIPTION OF THE DRAWINGS

FIG. 19 is an illustration of a mail format of mail sent to an equipment manager when the waste liquid tank is in a close-to-full state.

DETAILED DESCRIPTION OF THE PREFERRED EMBODIMENTS

Figure 1:
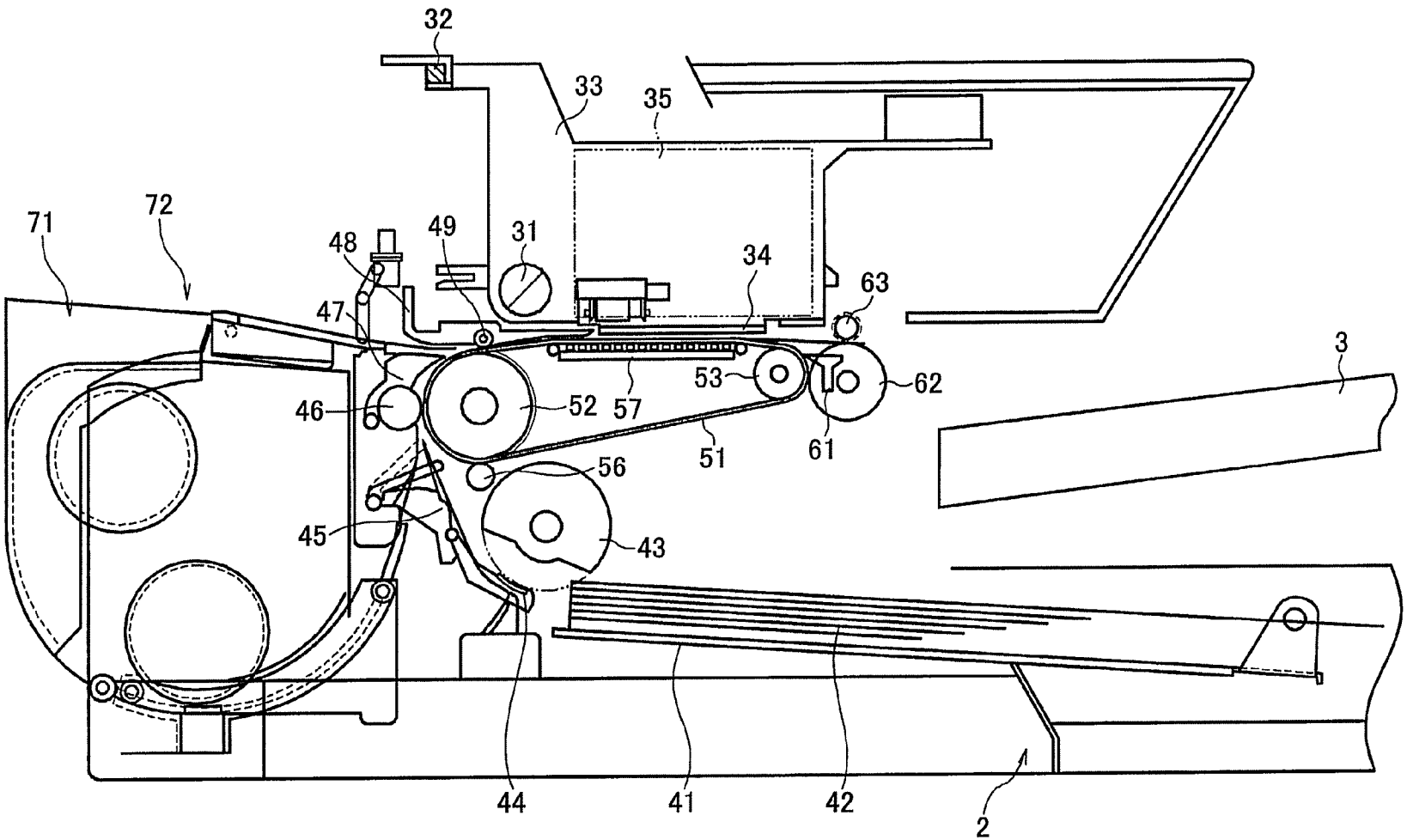
FIG. 1 is a side view of an inkjet recording apparatus, which is an example of an image forming apparatus according to an embodiment of the present invention.
Figure 2:
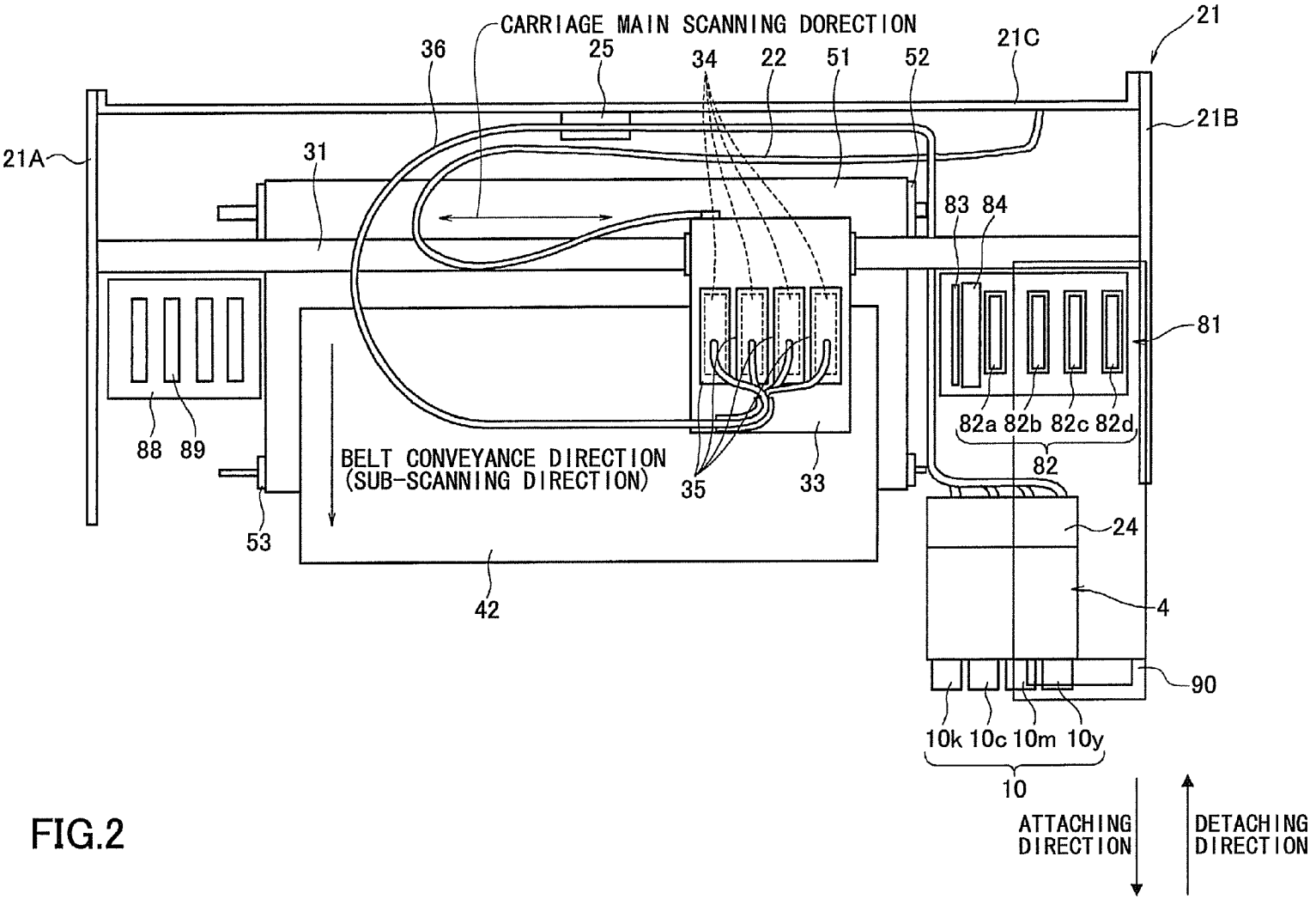
FIG. 2 is a plan view of the inkjet recording apparatus illustrated in FIG. 1.

A description will now be given, with reference to FIG. 1 through FIG. 18, of an embodiment of the present invention. FIG. 1 is a side view of an inkjet recording apparatus 1, which is an example of an image forming apparatus according to an embodiment of the present invention. FIG. 2 is a plan view of the inkjet recording apparatus 1 illustrated in FIG. 1.

In the inkjet recording apparatus 1, a carriage 33 is slidably supported by a guide rod 31 and a stay 32 that are guide members bridged between side plates 21A and 21B forming a frame 21. The carriage 33 is movable in directions (carriage main scanning directions) indicated by arrows in FIG. 2 by a main scanning motor (not illustrated in the figures) through a timing belt (not illustrated in the figures).

Attached to the carriage 33 are four recording heads 34, which are liquid droplet discharge heads for discharging ink droplets of yellow (Y), cyan (C), magenta (M) and black (Bk), respectively. Ink discharge ports of the recording heads 34 are aligned in a direction perpendicular to the main scanning direction and arranged so that ink droplets are discharged in a downward direction.

As for the recording head 34, an inkjet head having an actuator, such as a piezoelectric actuator, a thermal actuator, a shape memory alloy actuator, an electrostatic actuator, etc., as means for generating a pressure to discharge liquid droplets may be used. The piezoelectric actuator uses a piezoelectric device. The thermal actuator uses an electrothermal conversion element such as a heat-generating resistor to generate a phase change of a liquid caused by film boiling. The shape memory alloy actuator uses a metal phase change caused by a temperature change. The electrostatic actuator uses an electrostatic force.

All of the ink discharge ports may be driven simultaneously or may be driven at a different timing (time-divisional drive). If all of the ink discharge ports are driven simultaneously, there may be a problem such as a degradation in a recording quality due to cross-talking between ink discharge ports or an increase in a capacity of a power supply due to a large current being temporarily needed. The time-divisional drive of the ink discharge ports may eliminate such a problem.

A driver IC is mounted to each of the recording heads 34 and the driver IC is connected to a control unit (not illustrated in the figures) through a harness (flexible printed cable) 22.

Subtanks 35 are mounted to the carriage 33 to supply ink of each color to the recording heads 34. Ink of each color is supplied to the subtanks 35 from ink cartridges 10*k*, 10*c*, 10*m* and 10*y* attached to a cartridge holder 4, which is a cartridge attaching part, through ink supply tubes 36, respectively. The ink cartridges 10*k*, 10*c*, 10*m* and 10*y* may be referred to herein as an ink cartridge 10 if there is no need to distinguish each color. A supply pump unit is provided in the cartridge holder 4 to deliver the ink in each ink cartridge 10. The ink supply tubes 36 are engaged with a rear plate 21C, which is a part of the frame 21, by an engagement member 25.

A semilunar roller (paper supply roller) 43 and a separation pad 44 are provided as a paper supply part, which feeds papers 42 stacked on a paper stack part (pressure plate) 41 of a paper supply tray 2. The semilunar roller 43 separates and feeds the papers 42 one by one from the paper stack part 41. The separation pad 44 made of a material having a large coefficient of friction is arranged at a position opposite to the semilunar roller (paper supply roller) 43. The separation pad 44 is urged toward the paper supply roller 43.

A press member 48 is provided to feed the papers 42 to a position under the recording heads 34. The press member 48 includes a guide member 45 to guide the papers 42, a counter roller 46, a conveyance guide member 47, and an end press roller 49. Also provided is a conveyance belt 51, which is conveyance means for conveying the papers 42, in a position opposite to the recording heads 34 while electrostatically attracting the papers 42.

The conveyance belt 51 is an endless belt, which is bridged between a conveyance roller 52 and a tension roller 53 to be movable in a belt conveyance direction (a sub-scanning direction). The conveyance belt 51 includes a front layer providing a paper attaching surface and a back layer (a medium resistance layer or an earth layer). The front layer is made of a resin material such as a pure ethylene tetrafluoroethylene (ETFE) and has a thickness of about 40 μm. The front layer is not subjected to a resistance control.

A charge roller 56 as charging means for charging the surface of the conveyance belt 51 is arranged to be brought into contact with the front layer of the conveyance belt 51. The charge roller 56 is rotatable in association with a rotation of the conveyance belt 51 and configured and arranged to apply a predetermined press force as a pressure force to opposite ends of a shaft. It should be noted that the conveyance roller 52 plays a roll of an earth roller, and is grounded by being brought into contact with the middle resistance layer (back layer) of the conveyance belt 51.

Additionally, a guide member 57 is arranged on the back side of the conveyance belt 51 in correspondence with a print area of the recording heads 34. The guide member 57 is provided to maintain accurate flatness of the conveyance belt 51 by protruding an upper surface thereof from a tangential line of the two rollers (the conveyance roller 51 and the tension roller 53) supporting the conveyance belt 51. The conveyance belt 51 is rotatable in the belt conveyance direction (sub-scanning direction) by the conveyance motor being rotated by a sub-scanning motor (not illustrated in the figures).

Further, as a paper eject part for ejecting the papers 42, which have been subjected to recording by the recording heads 34, a separation claw 61 and paper eject rollers 62 and 63 are arranged near the tension roller 53. The separation claw 61 is provided to separate papers 42 from the conveyance belt 51. A paper eject tray 3 is situated under the paper eject roller 62. A distance from a point between the paper eject rollers 62 and 63 to the paper eject tray 3 is set large in order to increase a number of papers 42 stored in the paper eject tray 3.

A both-side unit 71 is detachably attached to a back part of the apparatus body 1, the both-side unit 71 takes and reverses the papers 42, which are returned by a reverse rotation of the conveyance belt 51, and feeds the reversed papers 42 to a position between the counter roller 46 and the conveyance belt 51.

As illustrated in FIG. 2, a maintenance and recovery mechanism 81 is arranged in a non-printing area of one side in the scanning direction of the carriage 33 in order to maintain and recover the function of the recording heads 34. A waste liquid tank 90 is situated under the maintenance and recovery mechanism 81 to collect ink recovered by the maintenance and recovery mechanism 81. The maintenance and recovery mechanism 81 includes cap members 82*a*, 82*b*, 82*c* and 82*d*, a wiper blade 83 and a dummy discharge receiver 84. The cap members 82*a*, 82*b*, 82*c* and 82*d* are for capping the nozzle surfaces of the recording heads 34, respectively. The cap members 82*a*, 82*b*, 82*c* and 82*d* may be simply referred to as a cap 82, if it is not necessary to distinguish the cap members from each other. The wiper blade 83 is provided for wiping the nozzle surfaces. The dummy discharge receiver 84 is provided for receiving liquid droplets when performing a dummy discharge operation to discharge droplets of a recording liquid having an increased viscosity, which droplets do not contribute to recording. In this example, the cap 82*a* is used as a suction and moisture retention cap, and the caps 82*b*, 82*c* and 82*d* are used as moisture retention caps.

The recording liquid (ink) ejected to the waste liquid tank 90 from among a waste recording liquid generated by a maintenance and recovery operation by the maintenance and recovery mechanism 81 is stored in the waste liquid tank 90. On the other hand, the recording liquid adhering to the wiper blade 83 and removed by a wiper cleaner and the recording liquid dummy-discharged to the dummy discharge receiver 84 are ejected to another waste liquid tank (not illustrated in the figures) located directly under the dummy discharge receiver 84.

As illustrated in FIG. 2, a dummy discharge receiver 88 is situated in a non-printing area on an opposite side in the scanning direction of the carriage 33 in order to receive droplets of the recording liquid when performing a dummy discharge for discharging recording liquid droplets, which have an increased viscosity during recording and do not contribute to the recording. The dummy discharge receiver 88 is provided with openings 89 aligned in a nozzle aligning direction of the recording heads 34.

A communication circuit part (an interface) such as a USB for exchanging data with a host is provided on the internal rear side of the apparatus body 1. Additionally, a control circuit board constituting a control part for controlling an entire operation of the image forming apparatus is provided on the internal rear side of the apparatus body 1.

In the inkjet recording apparatus 1 having the above-mentioned structure, the papers 42 are fed from the paper supply tray 2 one by one. The paper 42 fed in a vertical direction is guided by a guide 45, and is conveyed by being sandwiched between the conveyance belt 51 and the counter roller 46. Then, the leading edge of the paper 42 is guided by the guide 47 and is pressed against the conveyance belt 51 by the end press roller 49 to change the conveyance direction by 90 degrees.

Then, an alternate voltage, which is an alternate repetition of a plus voltage and a minus voltage, is applied to the charge roller 56 from an AC bias supply part by a control circuit (not illustrated in the figures). Thus, the conveyance belt 51 is charged in an alternate charge pattern, wherein a plus charge and a minus charge are alternately arranged with predetermined widths in the sub-scanning direction, which is the direction of rotation of the conveyance belt 51. Thus, the paper 42 is attracted by the conveyance belt 51 due to the alternate charge on the conveyance belt 51, and is conveyed in the sub-scanning direction by the rotation of conveyance belt 51.

Then, the recording heads 34 are driven in response to image signals while moving the carriage 33 in order to discharge ink droplets onto the paper 42, which is stopped, to record a single line. A recording of a next line is performed after the paper is conveyed by a predetermined distance. The recording operation is ended upon reception of a recording end signal or a signal indicating that a trailing edge of the paper 42 reached the recording area, and, then, the paper 42 is ejected onto the paper eject tray 3.

During a print (recording) standby period, the carriage 33 is moved to a side of the maintenance and recovery mechanism 81. The recording heads 34 are capped by the cap 82 to maintain the nozzles to be in a moist state to prevent a discharge error due to dehydration of the recording liquid (ink). Additionally, the recording liquid is suctioned from the nozzles by a suction pump (not illustrated in the figures) in a state where each of the recording heads 34 are capped by the cap 82 in order to carry out a recovery operation to eject the recording liquid having an increased viscosity or bubbles in the recording liquid. The recording liquid ejected is accumulated in the waste liquid tank 90. The waste liquid tank 90 is detached and attached in directions (a detaching direction and an attaching direction) indicated by arrows in FIG. 2. Additionally, before starting a recording operation or in a middle of the recording operation, a dummy discharge operation for discharging the recording liquid (ink), which does not contribute to recording, is performed. Thereby, a stable discharge performance of the recording heads 34 can be maintained.

Figure 3:
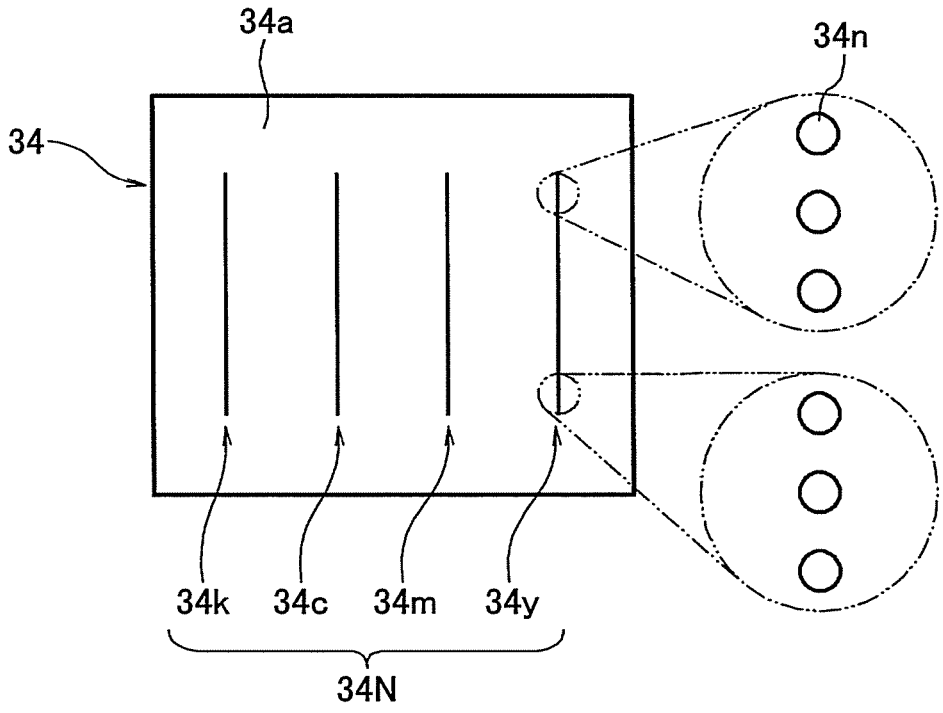
FIG. 3 is a plan view of a nozzle surface of another example of a recording head.

A description will now be given of a structure of the recording head 34. FIG. 3 is a plan view of a nozzle surface of another example of the recording head 34. The recording head illustrated in FIG. 3 has a nozzle surface 34*a* in which four nozzle trains 34*k*, 34*c*, 34*m* and 34*y* are formed. The nozzle trains 34*k*, 34*c*, 34*m* and 34*y* include a plurality of nozzles 34*n* for discharging droplets of recording liquid (ink) of each color such as black (K) ink, cyan (C) ink, magenta (M) ink and yellow (Y) ink, respectively. The nozzle trains 34*k*, 34*c*, 34*m* and 34*y* may be simply referred to as a nozzle train 34, if it is not necessary to distinguish the nozzle trains from each other.

Figure 4:
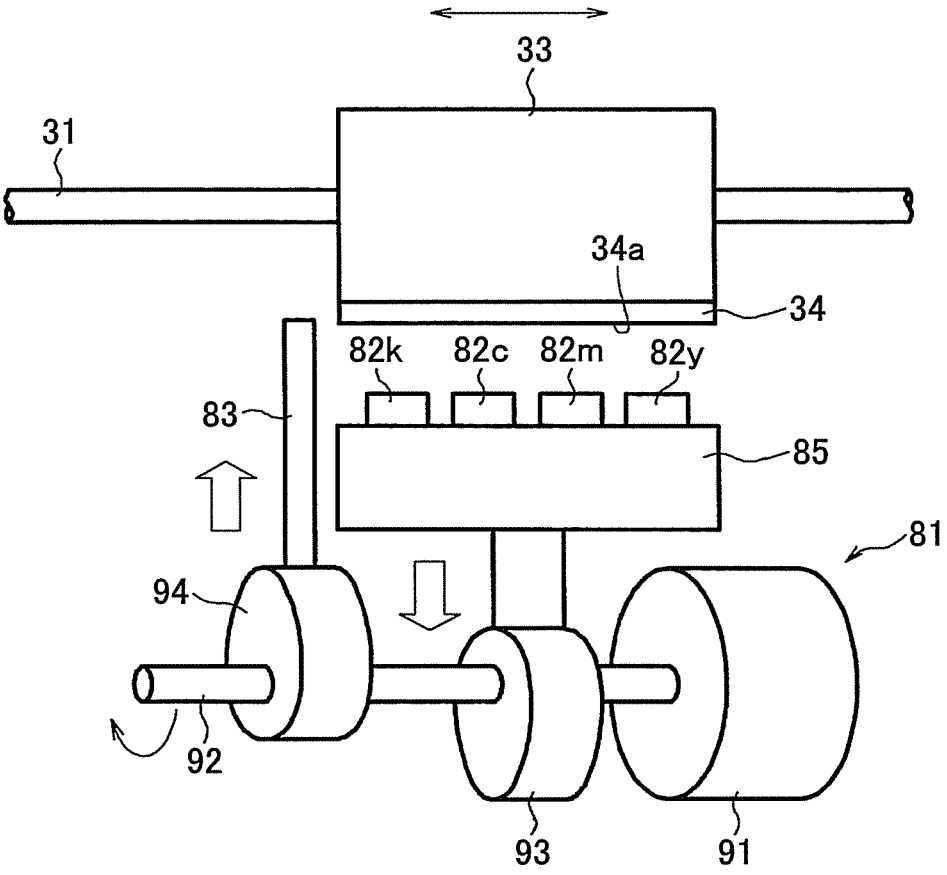
FIG. 4 is an illustration of a maintenance and recovery mechanism in a wiping state.
Figure 5:
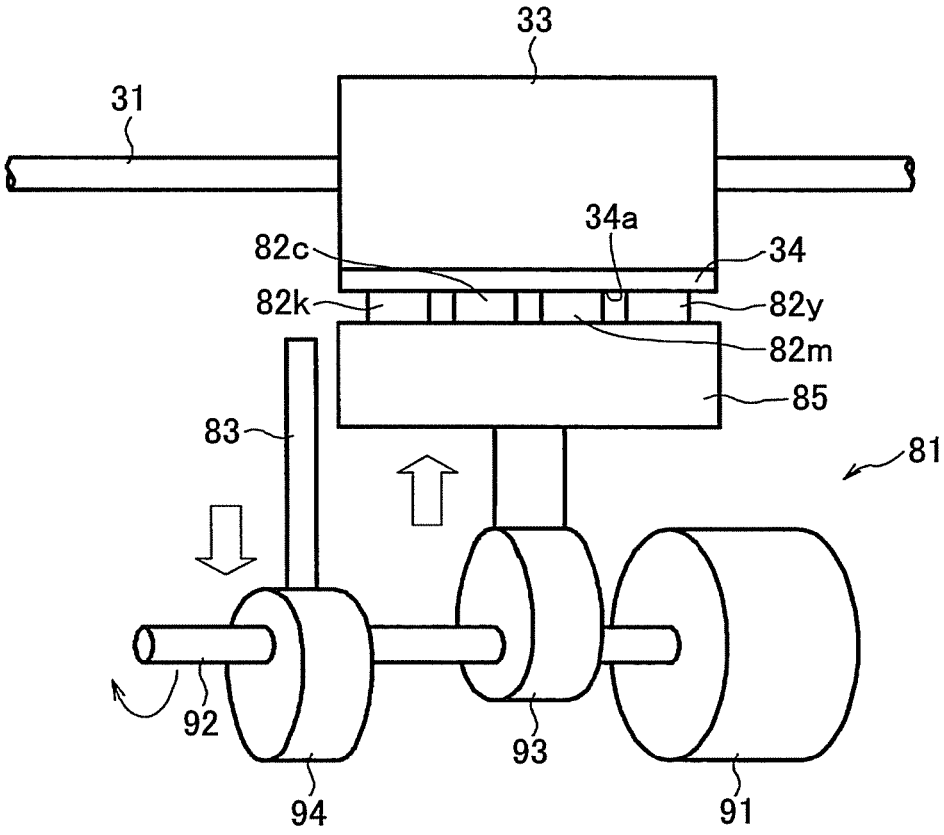
FIG. 5 is an illustration of the maintenance and recovery mechanism in a capping state.

A description will be given of a maintenance and recovery mechanism using the recording head 34 having the head structure illustrated in FIG. 3. FIG. 4 is an illustration of the maintenance and recovery mechanism in a wiping state. FIG. 5 is an illustration of the maintenance and recovery mechanism in a capping state.

The maintenance and recovery mechanism 81 has caps 82*k*, 82*c*, 82*m* and 82*y* for capping the nozzle trains 34*k*, 34*c*, 34*m* and 34*y*, respectively. The caps 82*k*, 82*c*, 82*m* and 82*y* are held by a cap holder 85. The maintenance and recovery mechanism 81 also has a wiper blade 83 for wiping (cleaning) the nozzle surface 34*a* of the recording head 34.

The maintenance and recovery mechanism includes a maintenance and recovery mechanism drive motor 91, a cam shaft 92 rotated by the motor 91 and a cap cam 93 and a wiper cam 94 attached to the cam shaft 92 in order to move the cap holder 85 and the wiper blade 83 upward and downward.

In the maintenance and recovery mechanism 81, in order to remove ink and impurities adhered to the nozzle surface 34*a* of the recording head 34, the maintenance and recovery mechanism drive motor 91 is driven to rotate the wiper cam 94 to move the wiper blade 83 upward, as illustrated in FIG. 4. In this state, the carriage 33 is moved in the main scanning direction to wipe the nozzle surface 34*a* by the wiper blade 83 in order to remove the ink and impurities.

If the nozzles 34*n* of the recording head 34 are left exposed to an atmosphere, ink inside the nozzles 34*n* may be dehydrated and solidified, which results in degradation of ink discharge performance. In order to prevent such degradation, the nozzles 34*n* are covered by the cap 82. Specifically, in order to cover the nozzle surface 34*a* of the recording head 34, the maintenance and recovery mechanism drive motor 91 is driven to rotate the cap cam 93 to move the cap 82 upward as illustrated in FIG. 4. Thereby the cap 82 of each color covers the respective nozzle train 34N of the nozzle surface 34*a*, which prevents ink in the nozzles 34*n* from being dehydrated.

Further, by rotating the maintenance and recovery mechanism drive motor 91 by ¼ rotation from the state illustrated in FIG. 4 and FIG. 5, it becomes possible to move the carriage 33 to prepare for a start of a printing operation. The maintenance and recovery mechanism 81 can also be applied to the above-mentioned structure in which a plurality of recording heads 34 are provided.

A description will now be given of the waste liquid tank 90. The following three states are detected as a state of the waste liquid tank 90. (1) normal: there is room in the waste liquid tank and the waste liquid tank is in a usable state. (2) close-to-full: the waste liquid tank will become full in a short time but is still in a usable state. (3) full: the waste liquid tank is full and is in a non-usable state.

Generally, for example, information regarding an amount of ink discharged to a waste liquid tank is accumulated in a non-volatile memory 616 in order to determine a state of the waste liquid tank. That is, the amount of waste liquid reaches a predetermined amount, it is determined that the waste liquid tank is in a close-to-full state. When a predetermined amount of waste liquid is discharged after the close-to-full state, it is determined that the waste liquid tank is in a full state. If the waste liquid tank is not in the close-to-full state or the full state, it is determined that the waste liquid tank is in a normal state.

If it is detected or determined that the waste liquid tank is in the full state, the recording apparatus is sent to a factory or a repair shop to replace the waste liquid tank, or a maintenance service person visits the user site to replace the waste liquid tank, which requires a large amount of labor and expense.

Conventionally, as mentioned above, information regarding an amount of waste liquid stored in the waste liquid tank is retained by the non-volatile memory provided in the apparatus body. Thus, if a user attaches a used waste liquid tank, in which some amount of ink has already been stored, an accurate amount of waste liquid in the waste liquid tank cannot be computed, which may cause a problem in that too much of the waste liquid is supplied to the waste liquid tank, which results in overflow of the waste liquid from the waste liquid tank. In order to solve such a problem, the waste liquid tank 90 of the inkjet recording apparatus 1 according to the present invention is provided with a memory element as a memory means to store information regarding an amount of waste liquid.

Figure 6:
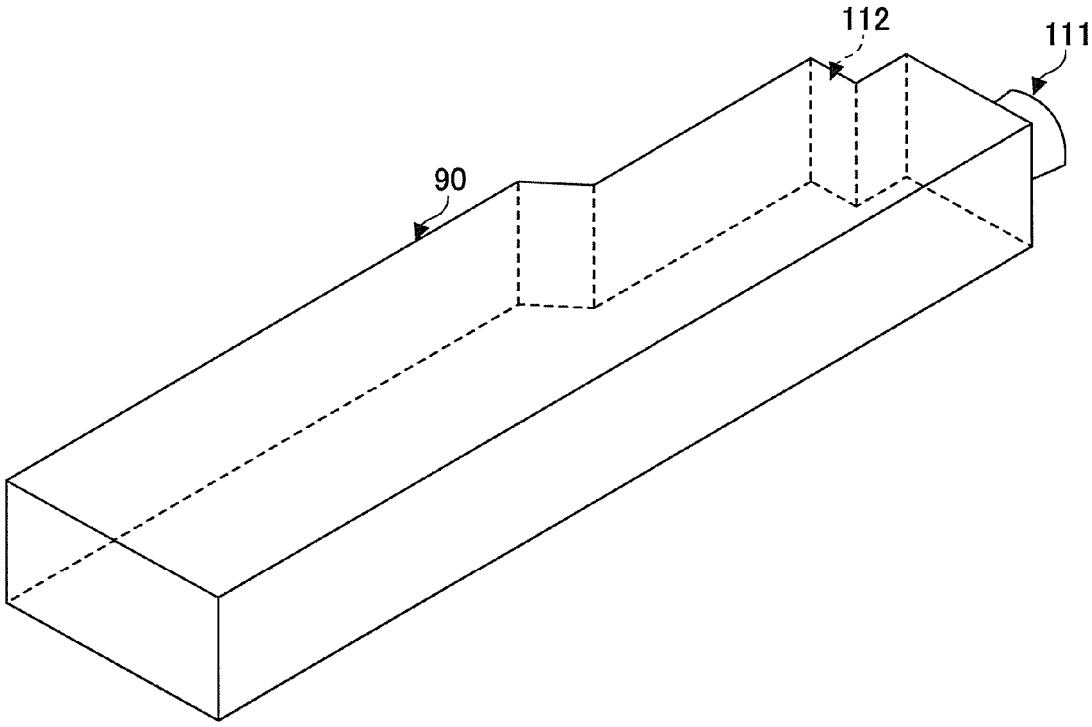
FIG. 6 is an illustration of a waste liquid tank.

As illustrated in FIG. 6, the waste liquid tank 90 is sealed except for a waste liquid supply port part 111, which is connected to a needle provided in an inner side of the apparatus body 1 when the waste liquid tank 90 is attached to the apparatus body 1. Additionally, a non-volatile memory 112 such as, for example, an EEPROM is provided on a surface of the side of the waste liquid supply port part 111 as a memory element for storing information regarding the waste liquid tank 90 such as information regarding an amount of waste liquid. The non-volatile memory 112 is electrically connected to electrodes provided deep inside the apparatus body 1 when the waste liquid tank 90 is attached to the apparatus body 1 so that information stored in the non-volatile memory 112 is supplied to the control part of the apparatus body 1.

Because the waste liquid accumulated in the waste liquid tank 90 is condensed and has a large viscosity and a large amount of recording liquid is suctioned in a cleaning operation, an amount of waste liquid ejected to the waste liquid tank 90 is larger than the recording liquid ejected to the dummy discharge receivers 84 and 88 on the left and right side. If the waste liquid tank 90 is continuously used without replacement, it is possible that the waste liquid tank 90 becomes full and the waste liquid may overflow from the waste liquid tank 90, which may cause contamination or malfunction of the inkjet recording apparatus 1. Accordingly, it is desirable to periodically replace the waste liquid tank 90 with a new one. In the inkjet recording apparatus 1 according to the present invention, the waste liquid tank 90 is made detachable so that a user can replace the waste liquid tank 90.

According to the inkjet recording apparatus 1, an accurate amount of waste liquid can be determined by providing the non-volatile memory 112 to the waste liquid tank 90 to store information regarding an amount of waste liquid in the non-volatile memory 112. Further, as mentioned later, by storing information regarding an amount of waste liquid of the waste liquid tank 90 in the memory unit of the apparatus body of the inkjet recording apparatus 1, a more accurate determination of an amount of waste liquid can be achieved as compared to the case where information of an amount of waste liquid is stored only in the non-volatile memory 112 of the waste liquid tank 90.

Figure 7:
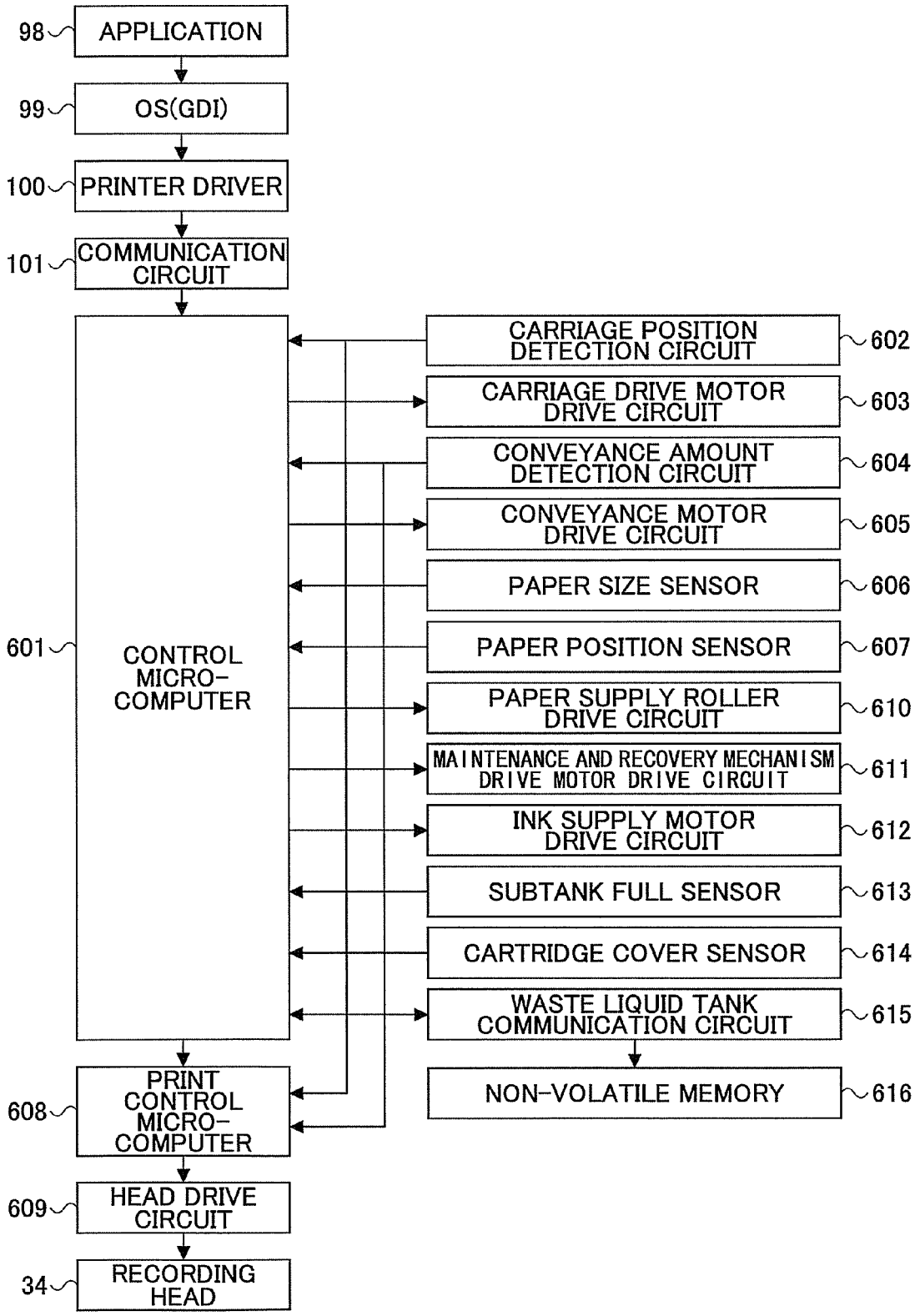
FIG. 7 is a functional block diagram of a control unit of the inkjet recording apparatus.

FIG. 7 is a functional block diagram of the control unit of the inkjet recording apparatus 1. A description will be given below of the control unit (control means) of the inkjet recording apparatus 1.

The control unit or control part controls an entire operation of the inkjet recording apparatus 1 (image forming apparatus). The control unit includes a control microcomputer 601 and a print control microcomputer 608. The control microcomputer 601 performs a determination process and a recovery operation associated with the present invention. The print control microcomputer 608 controls a printing operation.

When a print command is issued by a user through an application 98, an OS(GDI) 91 transfer image data to be output from the inkjet recording apparatus 1 (image forming apparatus) to a printer driver 100. Here, a graphic device interface (GDI) mounted to the operating system (OS) of Windows (registered trademark), such as Windows XP (registered trademark), is used as an example.

The printer driver 100 converts image date transferred from the application 98 into print image data of a format which the inkjet recording apparatus 1 can handle, and supplies the print image data to the inkjet recording apparatus 1 through a communication line 101.

The control microcomputer 601 controls a carriage drive motor and a conveyance motor through a carriage drive motor drive circuit 603 and a conveyance motor drive circuit 605 in order to form an image on the paper 42 in accordance with the print image data input from the communication line 101. The control microcomputer 601 also performs a control to send print data to the print control microcomputer 608.

The carriage position detection circuit 602 detects a position of the carriage 33, and outputs a detection signal to the control microcomputer 601. The microcomputer 601 controls a position and a moving speed of the carriage in accordance with the detection signal supplied from the carriage position detection circuit 602. The carriage position detection circuit 602 detects a position of the carriage 33 by detecting a number of slits provided in an encoder sheet arranged in a scanning direction of the carriage 33 by a photo sensor mounted on the carriage 33. The carriage drive motor drive circuit 603 drives the carriage drive motor in accordance with an amount of movement of the carriage 33 supplied from the control microcomputer 601 in order to move the carriage to a predetermined position at a predetermined speed.

A conveyance amount detection circuit 604 detects an amount of movement of the conveyance belt and outputs a detection signal to the control microcomputer 601. The control microcomputer 601 controls an amount of movement and a moving speed of the conveyance belt 51 in accordance with the detection signal supplied from the conveyance amount detection circuit 604. The conveyance amount detection circuit 604 detects an amount of conveyance of the conveyance belt 51 by detecting a number of slits provided in an encoder sheet attached to a rotation shaft of the conveyance roller 52 by a photo sensor. The conveyance motor drive circuit 605 drives the conveyance motor in accordance with the conveyance amount supplied from the control microcomputer 601 in order to drive the conveyance roller 52 to move the conveyance belt 51 to a predetermined position at a predetermined speed.

The control microcomputer 601 controls the paper supply roller 43 to rotate one turn by giving a paper supply roller drive instruction to a paper supply roller drive circuit 610. The control microcomputer 601 controls the caps 82 and the wiper blade 83 to move upward and downward by driving the motor 91 through a maintenance and recovery mechanism drive motor drive circuit 611.

The control microcomputer 601 controls an ink supply motor for driving a pump of the supply unit 24 through an ink supply motor drive circuit 612 in order to supply ink from an ink cartridge 10 mounted to the cartridge holder 4 to the subtank 35.

A subtank full sensor 613 detects a full state of the subtank 35 and outputs a detection signal to the control microcomputer 601. A cartridge cover sensor 614 detects opening and closing of a front cover 6 of the cartridge attach part 4 and outputs a detection signal to the control microcomputer 601.

The control microcomputer 601 retrieves information stored in the non-volatile memory 112, which is a memory element (storage means) attached to the waste liquid tank 90, through a waste liquid tank communication circuit 615, and performs a predetermined process such as a summing operation of ink suction amount in accordance with the information from the non-volatile memory 112 and stores a result in the non-volatile memory 616, which is a memory unit (body storage means).

The print control microcomputer 608 creates data for driving a pressure generating mechanism of the recording head 34 to discharge liquid droplets in accordance with signals supplied from the control microcomputer 601 and information regarding a carriage position and a carriage conveyance amount supplied from the carriage position detection circuit 602 and the conveyance amount detection circuit 604, and supplies the created data to a head drive circuit 609. The head drive circuit 609 drives the pressure generating mechanism of the recording head 34 in accordance with print data supplied from the print control microcomputer 608 to discharge liquid droplets from desired nozzles.

The control microcomputer 601 detects a size of a paper being fed by a detection signal supplied from a paper size sensor 606 in order to determine whether the image of input image data can be arranged on the paper. The control microcomputer 601 may instruct the print control microcomputer 608 to trim and draw image data if there is an image at a position outside the paper. A paper size (a paper width) can be detected by a reflection type sensor arranged on a side part of the carriage 33, which sensor detects a difference in reflectance between a paper and a conveyance path when the carriage is moved. A paper width may be detected by providing a line sensor on the conveyance path perpendicularly to the conveyance direction. A paper length in the conveyance direction can be detected by a reflection type sensor provided on the conveyance path to count an amount of conveyance from detection of a paper.

The control microcomputer 601 can detect a position of a paper in the inkjet recording apparatus 1 from signals supplied from a plurality of paper position sensors 607 located on the conveyance path. Thus, if a paper is present at an unexpected position during printing, it can be determined that a paper jam occurs and a notification of an abnormality may be sent to a user and a location of the abnormality can be indicated.

Figure 8:
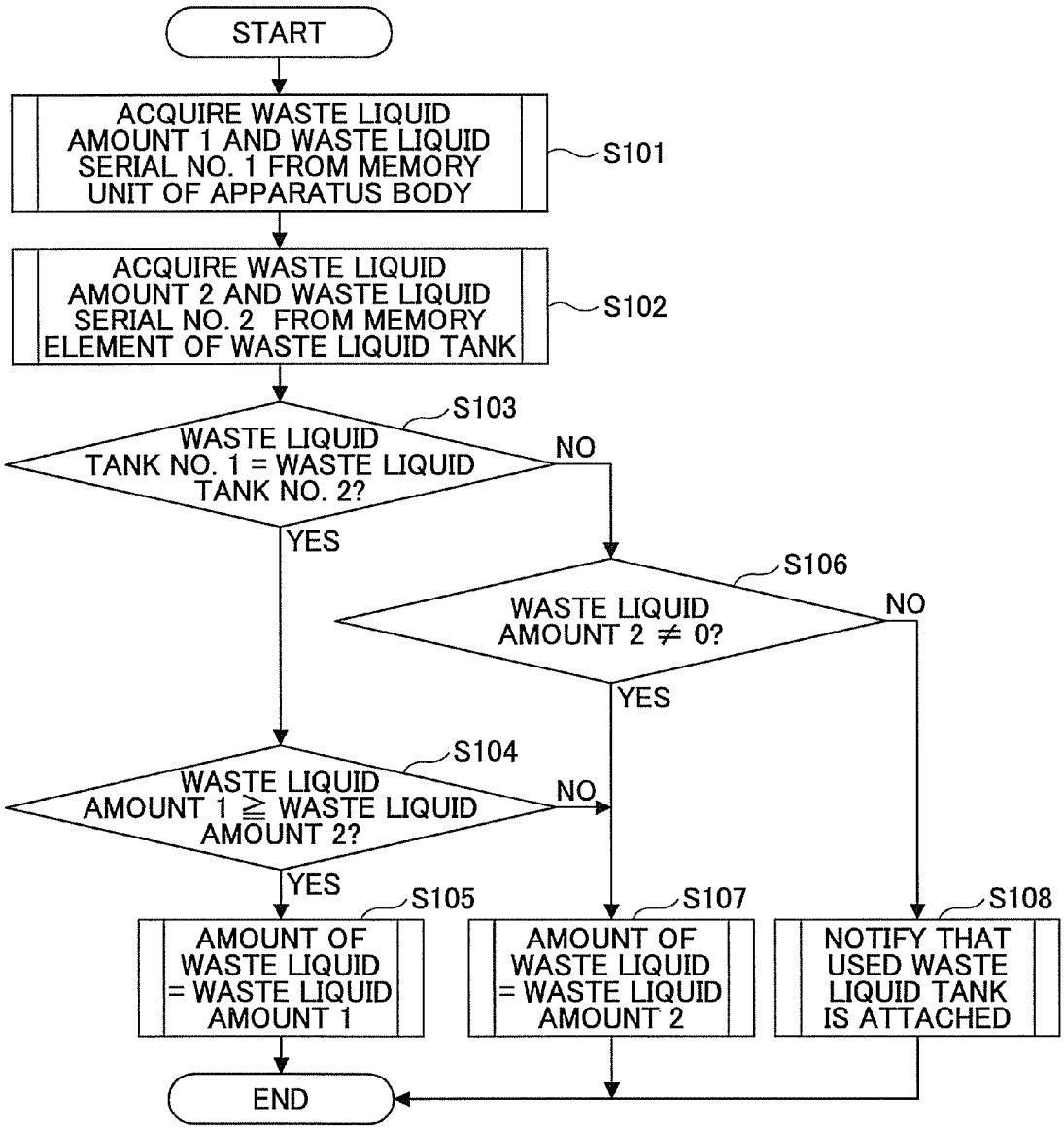
FIG. 8 is a flowchart of a waste liquid management process performed by the inkjet recording apparatus.

FIG. 8 is a flowchart of a waste liquid management process performed by the inkjet recording apparatus 1 (image forming apparatus) to update an amount of waste liquid currently stored in the waste liquid tank 90. According to the waste liquid management process, when it is detected that the waste liquid tank 90 is attached to the inkjet recording apparatus 1, information indicating an amount of waste liquid stored in the memory unit (the non-volatile memory 616) of the apparatus body of the inkjet recording apparatus 1 is compared with information indicating an amount of waste liquid stored in the memory element (the non-volatile memory 112). A detecting operation of the waste liquid tank 90 being attached to the inkjet recording apparatus 1 is triggered by turning on a main power of the inkjet recording apparatus 1 or closing a cartridge cover.

First, information of an amount of waste liquid (hereinafter, referred to as "waste liquid amount 1") and identification information of the waste liquid tank 90 attached at the previous time are acquired from the memory unit (storage means) of the apparatus body of the inkjet recording apparatus 1 (S101). Hereinafter, the identification information acquired in S101 is referred to as "waste liquid tank serial No. 1". Although a full state of the waste liquid tank 90 is expressed as "waste liquid amount=0" in the present embodiment, the expression is not limited to the above and other expressions such as, for example, numerical values "100" or "999" and a character string "full" may be used.

Subsequently, information indicating an amount of waste liquid (hereinafter, referred to a "waste liquid amount 2") and identification information of the waste liquid tank 90 attached to the inkjet recording apparatus 1 at this time are acquired from the memory element (storage means) provided in the waste liquid tank 90 (S102). Hereinafter, the identification information acquired in S102 is referred to as "waste liquid tank serial No. 2".

Then, the waste liquid tank serial No. 1 and the waste liquid serial No. 2 are compared with each other (S103). If the waste liquid tank serial No. 1 matches the waste liquid tank serial No. 2 (YES of S103), it is determined that the waste liquid tank 90 has not been replaced. Then, the waste liquid amount 1 and the waste liquid amount 2 are compared with each other (S104), and one of the waste liquid amount 1 and the waste liquid amount 2 having a larger value is set as an amount of waste liquid currently stored in the waste liquid tank 90 (S105, S107). Accordingly, if a value of an amount of waste liquid retained by the memory unit of the apparatus body of the inkjet recording apparatus 1 differs from a value of an amount of waste liquid retained by the memory element of the waste liquid tank 90, a larger value is selected as a value of an amount of waste liquid currently stored in the waste liquid tank 90, which permits a control to prevent the waste liquid from overflowing from the waste liquid tank 90.

On the other hand, if the waste liquid tank 90 is detached from the apparatus body of the inkjet recording apparatus 1 after information of an amount of waste liquid is stored in the memory unit of the apparatus body and before information of an amount of waste liquid is stored in the memory element of the waste liquid tank 90, the value stored in the memory unit of the apparatus body may be different from the value stored in the memory element of the waste liquid tank 90. Thus, if the waste liquid tank serial No. 1 does not match the waste liquid tank serial No. 2 (NO of S103), it is determined that the waste liquid tank 90 has been replaced. Then, it is checked whether the waste liquid amount 2 is not equal to zero (waste liquid amount 2≠0) (S106). If the waste liquid amount 2 is equal to zero (waste liquid amount 2=0) (NO of S106), a notification is sent to a user to indicate that a used waste liquid tank has been attached to the inkjet recording apparatus 1 (S108). According to this process, a user is notified in a way easy to understand that the waste liquid tank, which the user attached to the inkjet recording apparatus 1, has already been in a "full" state.

On the other hand, if the waste liquid amount 2 is not equal to zero (waste liquid amount 2≠0) (YES of S106), the waste liquid amount 2 is set as an amount of waste liquid currently stored in the waste liquid tank 90 (S107). According to this determination, even if the waste liquid tank 90 is replaced, an accurate amount of waste liquid currently stored in the waste liquid tank 90 can be acquired.

Thereafter, at each time a maintenance is carried out, an amount of waste liquid discharged during a forcible ink suction process of a maintenance operation (hereinafter, referred to as "maintenance waste liquid amount") is added to the current amount of waste liquid set in S107. The value of the sum of the amount of waste liquid set in S107 and the maintenance waste liquid amount is stored in the memory unit (the non-volatile memory 616) of the apparatus body of the inkjet recording apparatus 1 and/or the memory element (the non-volatile memory 112) of the waste liquid tank 90, which results in updating information indicating an amount of waste liquid currently stored in the waste liquid tank 90. The maintenance waste liquid amount may be previously set to a predetermined value corresponding to an amount of waste liquid generated during a one-time maintenance operation, or may be calculated based on a suction time (seconds) by a suction pump in a maintenance operation. As mentioned later, if the state of the waste liquid tank 90 becomes "close-to-full" or "full" by addition of the maintenance waste liquid amount, it may be desirable to give warning or stop an operation of the inkjet recording apparatus 1.

Figure 9:
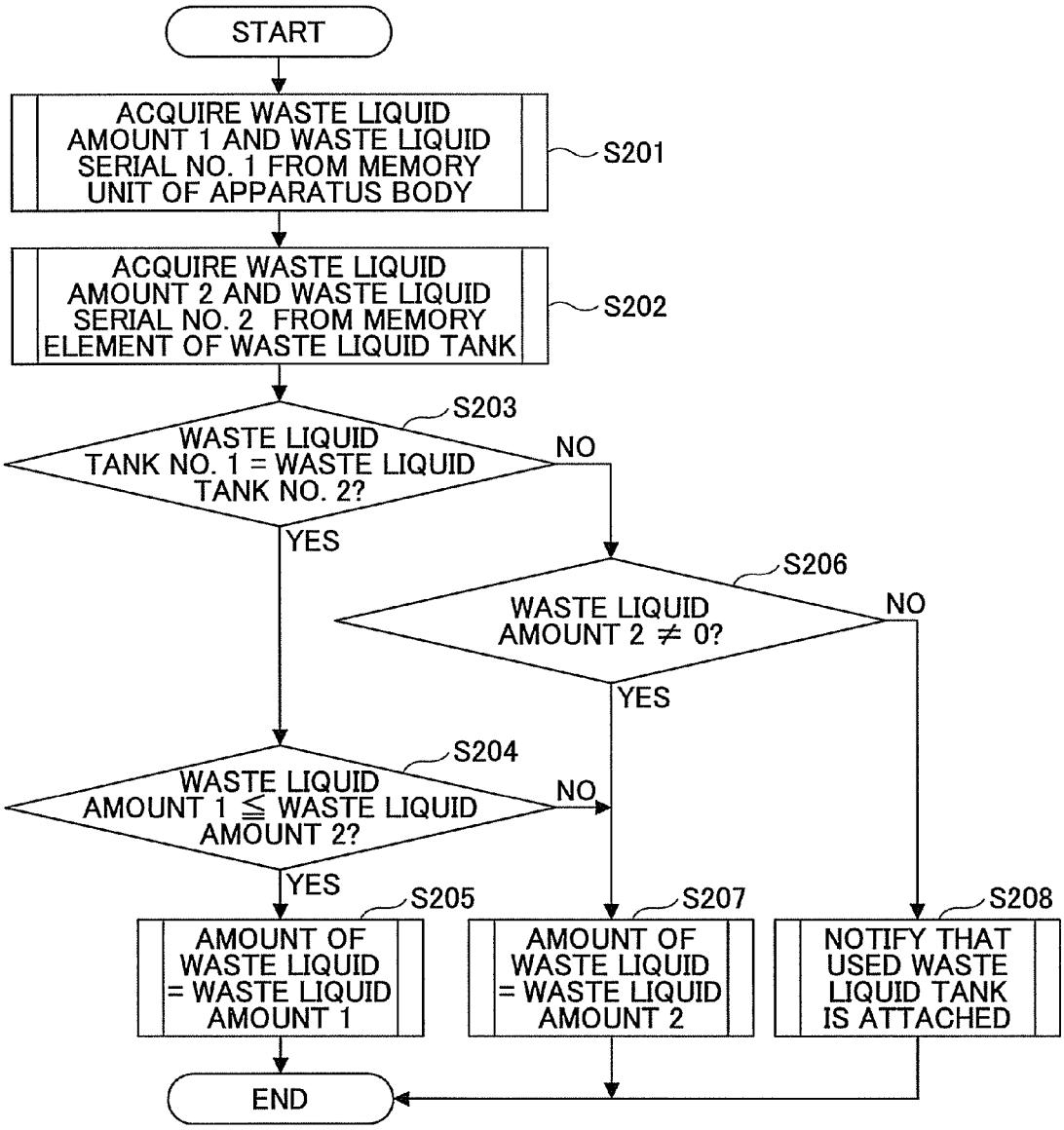
FIG. 9 is a flowchart of another waste liquid management process performed by the inkjet recording apparatus.

FIG. 9 is a flowchart of another waste liquid management process performed by the inkjet recording apparatus 1 (image forming apparatus). The waste liquid management process explained below may be performed instead of the waste liquid management process illustrated in FIG. 8.

First, information of an amount of waste liquid (hereinafter, referred to as "waste liquid amount 1") and identification information of the waste liquid tank 90 attached at the previous time are acquired from the memory unit (storage means) of the apparatus body of the inkjet recording apparatus 1 (S201). Hereinafter, the identification information acquired in S201 is referred to as "waste liquid tank serial No. 1". Subsequently, information indicating an amount of waste liquid (hereinafter, referred to a "waste liquid amount 2") and identification information of the waste liquid tank 90 attached to the inkjet recording apparatus 1 at this time are acquired from the memory element (storage means) provided in the waste liquid tank 90 (S202). Hereinafter, the identification information acquired in S202 is referred to as "waste liquid tank serial No. 2".

Then, the waste liquid tank serial No. 1 and the waste liquid serial No. 2 are compared with each other (S203). If the waste liquid tank serial No. 1 matches the waste liquid tank serial No. 2 (YES of S203), it is determined that the waste liquid tank 90 has not been replaced. Then, the waste liquid amount 1 and the waste liquid amount 2 are compared with each other (S204), and one of the waste liquid amount 1 and the waste liquid amount 2 having a smaller value is set as an amount of waste liquid currently stored in the waste liquid tank 90 (S205, S207). Accordingly, if a value of an amount of waste liquid retained by the memory unit of the apparatus body of the inkjet recording apparatus 1 differs from a value of an amount of waste liquid retained by the memory element of the waste liquid tank 90, a smaller value is selected as a value of an amount of waste liquid currently stored in the waste liquid tank 90, which permits a user to use the present waste liquid tank 90 for a long time.

On the other hand, if the waste liquid tank serial No. 1 does not match the waste liquid tank serial No. 2 (NO of S203), it is determined that the waste liquid tank 90 has been replaced. Then, it is checked whether the waste liquid amount 2 is not equal to zero (waste liquid amount 2≠0) (S206). If the waste liquid amount 2 is equal to zero (waste liquid amount 2=0) (NO of S206), a notification is sent to a user to indicate that a used waste liquid tank has been attached to the inkjet recording apparatus 1 (S208). According to this process, a user is notified in a way easy to understand that the waste liquid tank, which the user attached to the inkjet recording apparatus 1, has already been in a "full" state.

On the other hand, if the waste liquid amount 2 is not equal to zero (waste liquid amount 2≠0) (YES of S206), the waste liquid amount 2 is set as an amount of waste liquid currently stored in the waste liquid tank 90 (S207). According to this determination, even if the waste liquid tank 90 is replaced, an accurate amount of waste liquid currently stored in the waste liquid tank 90 can be acquired.

Figure 10:
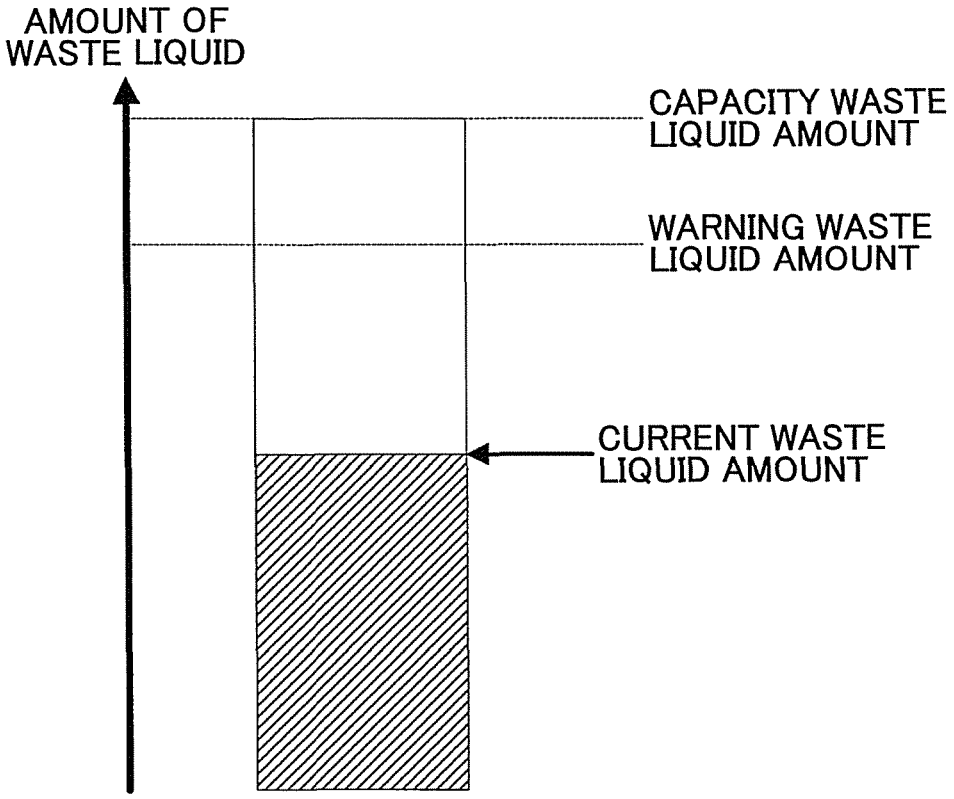
FIG. 10 is an illustration of a normal state of the waste liquid in the waste liquid tank.

A description will be given, with reference to FIG. 10 through FIG. 14, of a process of warning or stopping operation in response to an amount of waste liquid of the waste liquid tank 90. As illustrated in FIG. 10, an allowable amount of waste liquid stored in the waste liquid tank 90 (hereinafter, referred to as "capacity waste liquid amount") and a threshold amount of waste liquid at which a warning is generated (hereinafter, referred to as "warning waste liquid amount") are previously set. Information indicating the capacity waste liquid amount and information indicating the warning waste liquid amount are stored in the memory unit (the non-volatile memory 116) of the apparatus body of the inkjet recording apparatus 1 or the memory element (the non-volatile memory 112) of the waste liquid tank 90. FIG. 10 illustrates a state (normal state) where the current amount of waste liquid is less than the capacity waste liquid amount and the warning waste liquid amount.

Figure 11:
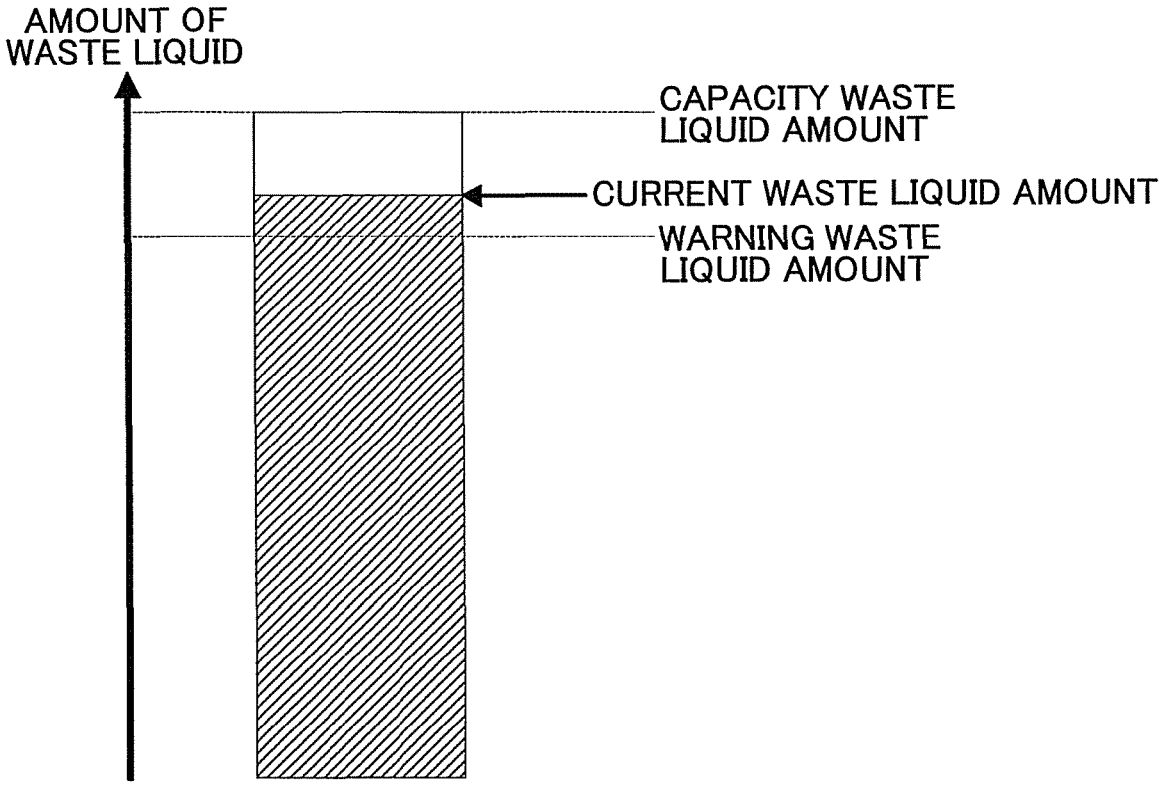
FIG. 11 is an illustration of a close-to-full state of the waste liquid in the waste liquid tank.

Additionally, if the current amount of waste liquid exceeds the warning waste liquid amount (close-to-full state) as illustrated in FIG. 11, a notification is sent to a user that the waste liquid tank will be full soon. According to this notification, the user can prepare a new waste liquid tank before the present waste liquid tank 90 becomes full.

Figure 12:
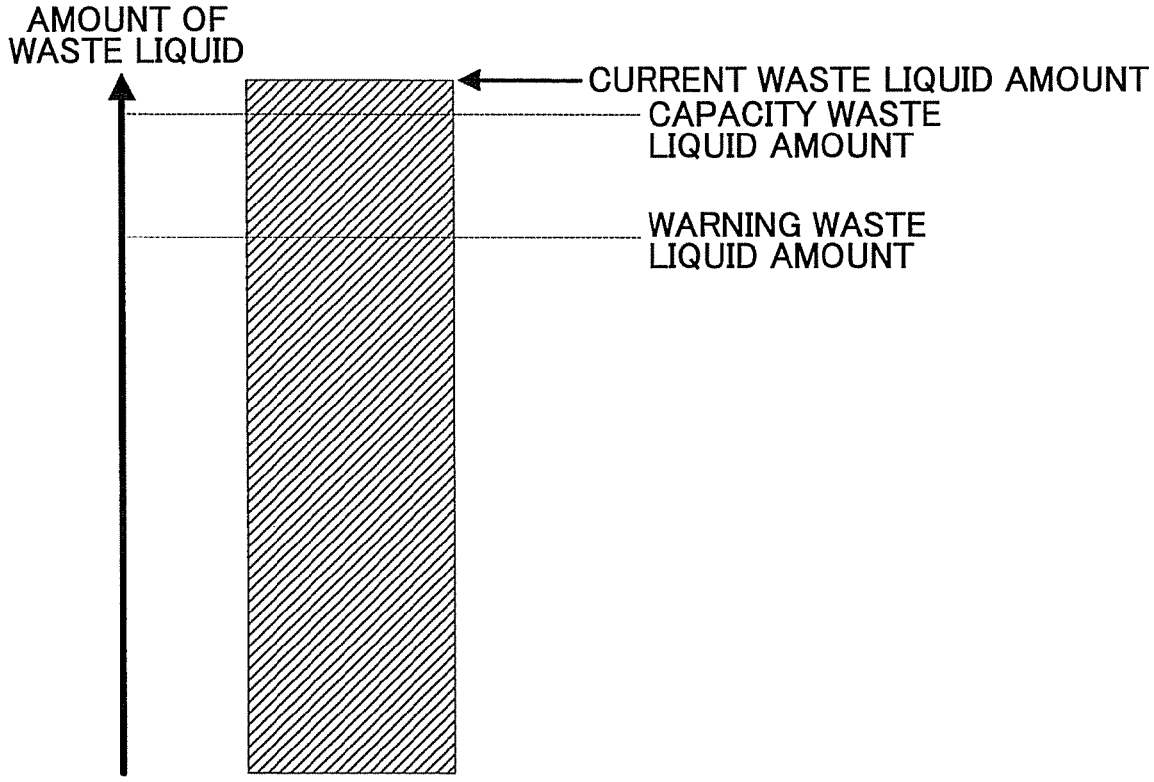
FIG. 12 is an illustration of a full state of the waste liquid in the waste liquid tank.

Further, if the current waste liquid amount exceeds the capacity waste liquid amount (full state) as illustrated in FIG. 12, the full state is detected and an operation of the inkjet recording apparatus 1 is stopped and a notification of an abnormality is sent to a user. According to this process, the interior of the apparatus body of the inkjet recording apparatus 1 is prevented from being contaminated by a waste liquid overflowing from the waste liquid tank 90.

Figure 13:
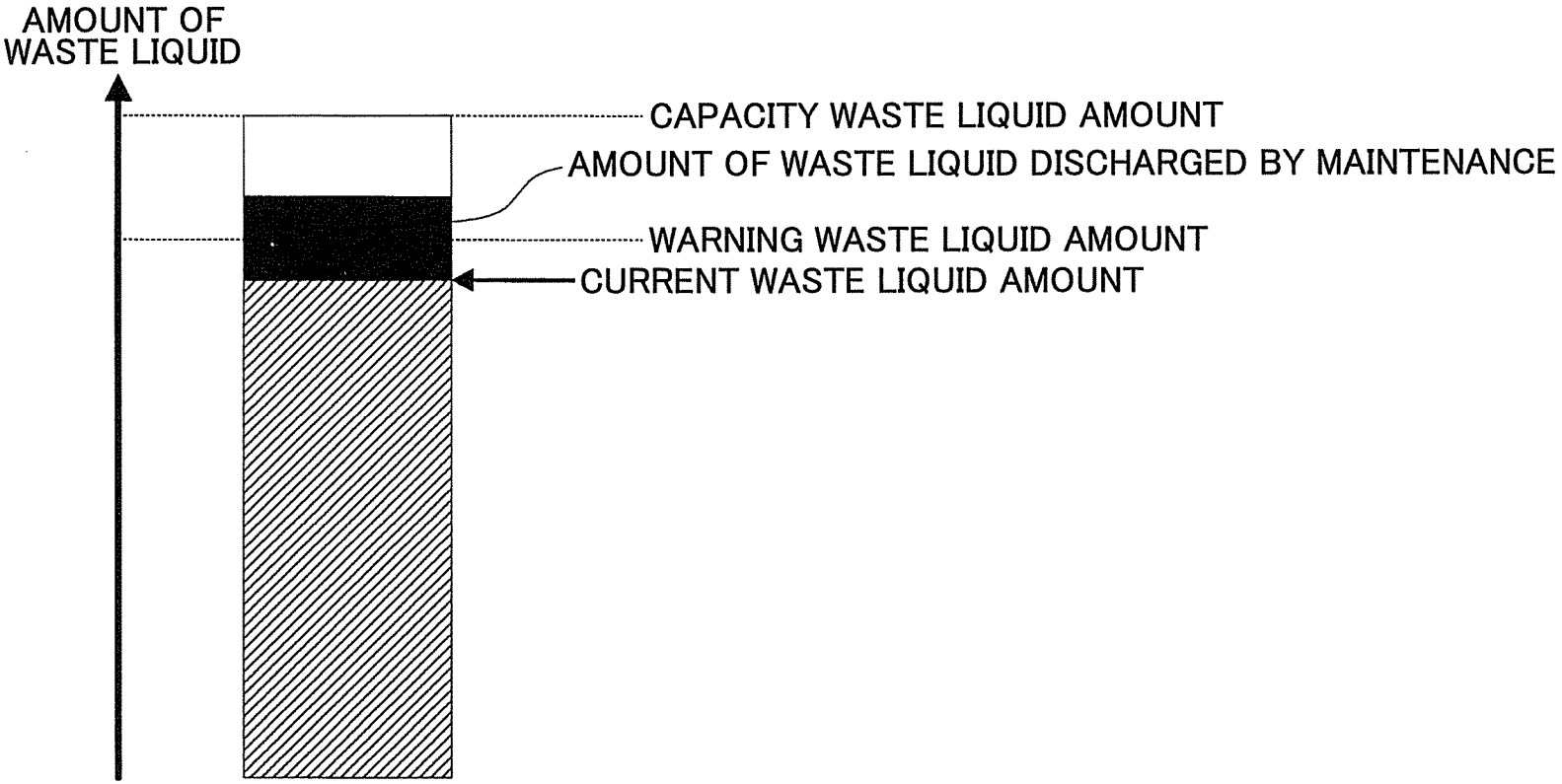
FIG. 13 is an illustration of a close-to-full state of the waste liquid in the waste liquid tank with an indication of an amount of waste liquid discharged in a maintenance operation.
Figure 14:
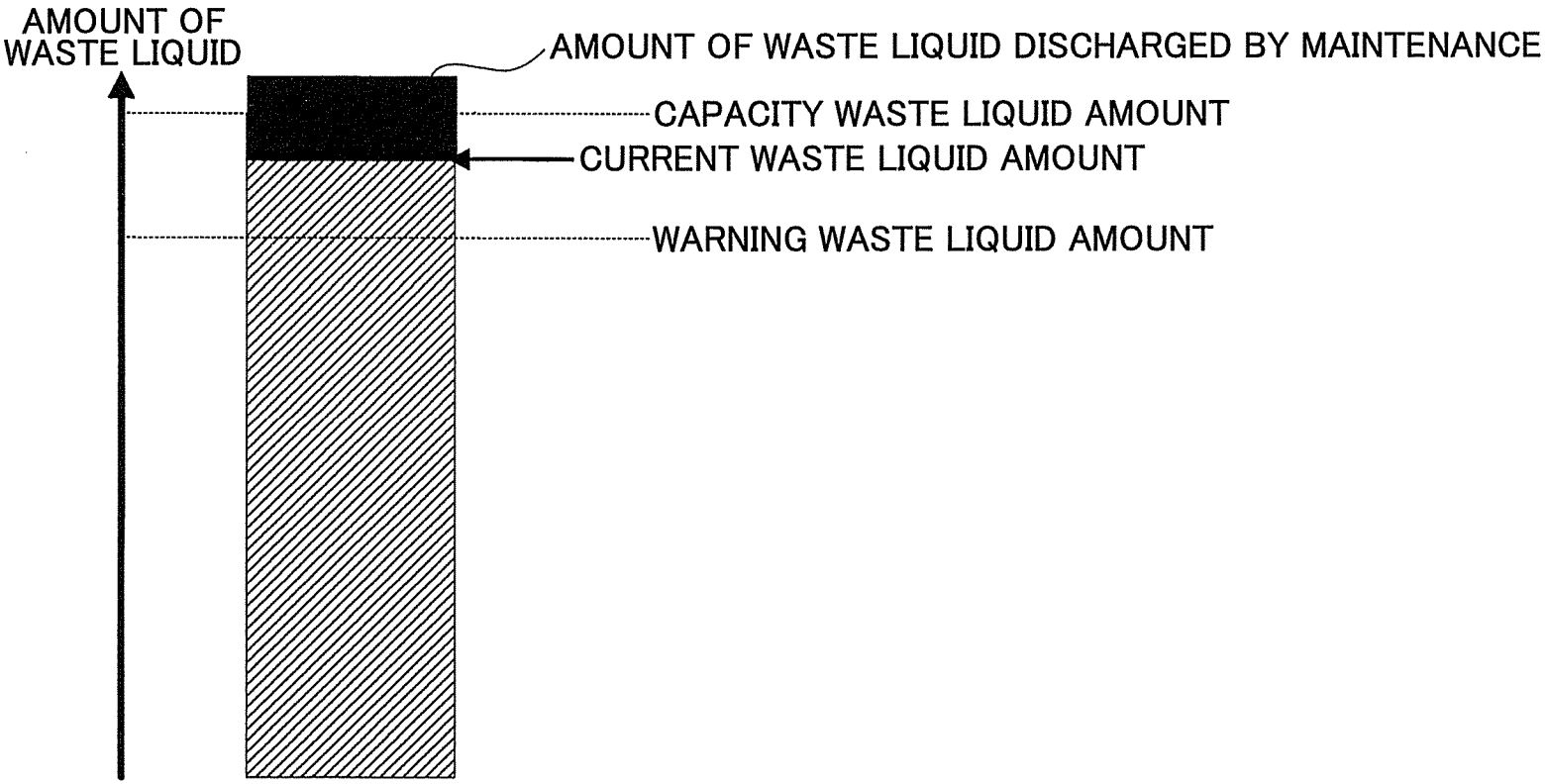
FIG. 14 is an illustration of a full state of the waste liquid in the waste liquid tank with an indication of an amount of waste liquid discharged in a maintenance operation.

A description will now be given, with reference to FIGS. 13 and 14, of a process of warning or operation stopping in response to an amount of waste liquid stored in the waste liquid tank 90 during a maintenance operation. An amount of waste liquid discharged during a maintenance operation is estimated before carrying out the maintenance operation as illustrated in FIG. 13, and the estimated amount is added to the current waste liquid amount to compare with the capacity waste liquid amount and the warning waste liquid amount. The estimated amount of the waste liquid used in the maintenance operation may be previously set to a predetermined amount in accordance with the contents of the maintenance operation. If the sum of the estimated amount and the current waste liquid amount exceeds the warning waste liquid amount (close-to-full state), a notification is sent to a user beforehand that a warning will be made. According to this process, the user is notified beforehand that a warning will be made if the maintenance operation is carried out. Additionally, the control microcomputer 601 can make a determination whether to carry out the maintenance operation in accordance with predetermined determination criteria.

Additionally, if the sum of the estimated amount and the current waste liquid amount exceeds the capacity waste liquid amount (full state), a notification is sent to a user beforehand that a waste liquid abnormality occurs if the maintenance operation is carried out. According to this process, the user can be notified beforehand that a warning is made if the maintenance operation is carried out. Additionally, the control microcomputer 601 can make a determination that the maintenance operation should be cancelled.

Figure 15:
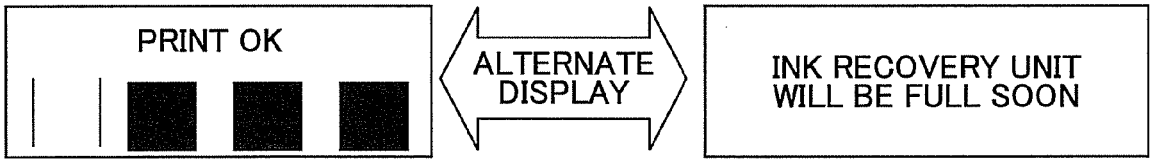
FIG. 15 is an illustration of a display indicated on a display part of an apparatus body when the waste liquid tank is in a close-to-full state.

FIG. 15 is an illustration of contents of display on a display part (LCD panel) of the apparatus body of the inkjet recording apparatus 1 when an amount of waste liquid exceeds the warning waste liquid amount (close-to-full state). By making a warning display on the display part of the apparatus body of the inkjet recording apparatus 1, the user is notified that the waste liquid tank 90 is in the close-to-full state to prompt the user to replace the waste liquid tank 90. In FIG. 15, the warning display is illustrated on the right side, and an indication of "PRINT OK" is illustrated on the left side. The warning display and the "PRINT OK" display may be displayed alternately at a fixed time interval such as, for example, a few seconds.

Additionally, a remaining storable amount of waste liquid (%) calculated based on the capacity waste liquid amount of the waste liquid tank 90 previously stored in the memory unit or the memory element and the current waste liquid amount may be displayed on the display part of the apparatus body of the inkjet recording apparatus 1. The remaining storable amount of waste liquid may be printed as one of items printed on a summary print containing various pieces of information regarding the entire inkjet recording apparatus 1, which is referred to by a maintenance service person. Accordingly, a user or a maintenance service person can recognize an amount of waste liquid which can be discharged when the waste liquid tank 90 is in the close-to-full state or the full state.

Figure 16:
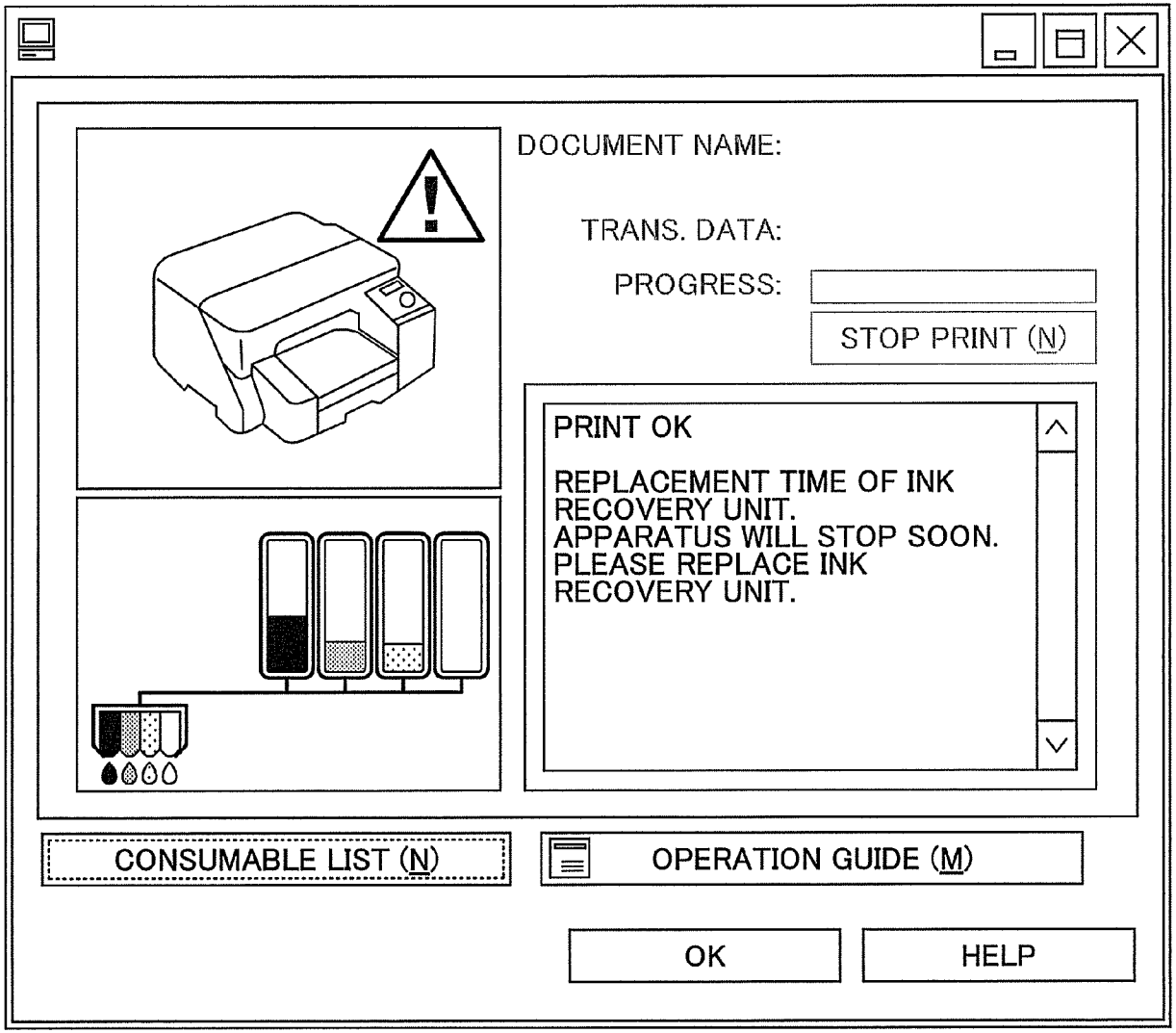
FIG. 16 is an illustration of a display indicated on a screen of a personal computer when the waste liquid tank is in a close-to-full state.

The notification of an amount of waste liquid to a user can be made by a display on a display panel of the apparatus body, a display using a screen of a printer driver or a display using a screen of electronic mail. FIG. 16 illustrates a screen of a status monitor displayed on a display part of a personal computer connected to the apparatus body of the inkjet recording apparatus 1 when an amount of waste liquid exceeds the warning waste liquid amount (close-to-full state). By displaying as illustrated in FIG. 16, the user is notified of a status of the inkjet recording apparatus 1 even if the user does not look at the display part of the inkjet recording apparatus 1 to prompt the user to replace the waste liquid tank 90.

Figure 17:
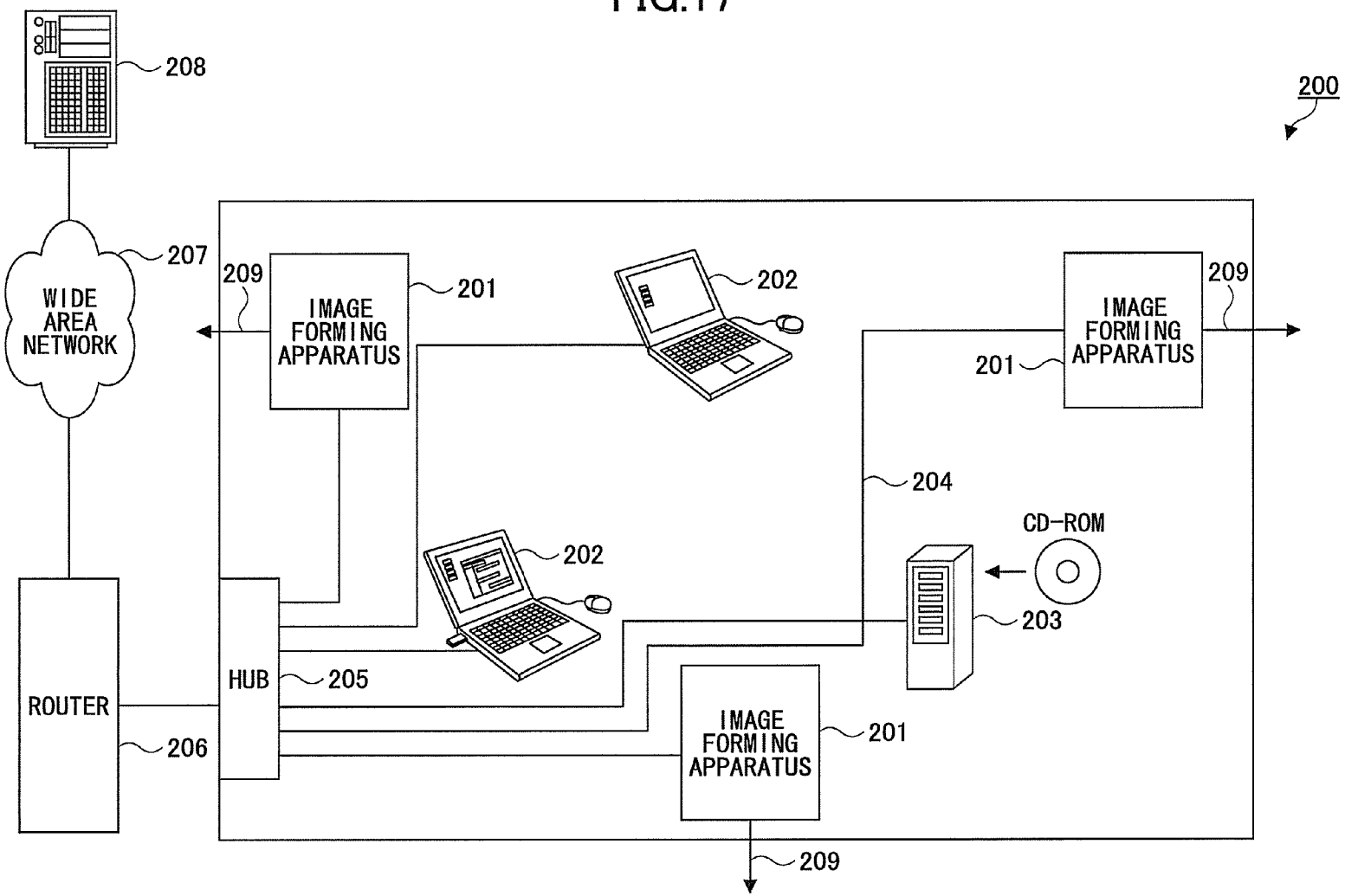
FIG. 17 is an illustration of a network system including an image forming apparatus.

FIG. 17 illustrates a network system 200 including image forming apparatuses according to the embodiment of the present invention.

In the network system 200 illustrated in FIG. 17, image forming apparatuses 201, an information processing apparatus 202 and a server 203 are interconnected by a local area network (LAN) 204 such as Ethernet (registered trademark). The LAN 204 physically connects the image forming apparatuses 201, the information processing apparatus 202, the server 203, etc., by a hub 205. The terminals and devices in the network system 200 perform mutual communications using a media access control (MAC) address and an IP address.

The hub 205 is connected to a router 206. The router 206 connects the image forming apparatuses 201, the information processing apparatus 202 and the server 203 to a wide area networks (WAN) 207). A POP server 208 is connected to the wide area network 207 in order to permit electronic mail transmission with the image forming apparatuses 201, the image processing apparatus 202 and the server 203 according to a SMTP protocol. A Web server other than the POP server 208 illustrated in FIG. 17 may be connected to the wide area network 207. The POP server 208 may be a mail server which ISP or the like offers, or may be mounted as a mail dedicated server installed in the office.

Each image forming apparatus 201 provides complex functions such as a facsimile function, a copy function, a printer function, an auto reverse document feeder (ARDF) function, etc. Each image forming apparatus 201 performs image forming operation by processing a direct instruction from a user, a job request from the information processing apparatus 202 and facsimile data received from a public telephone network 209.

Figure 18:
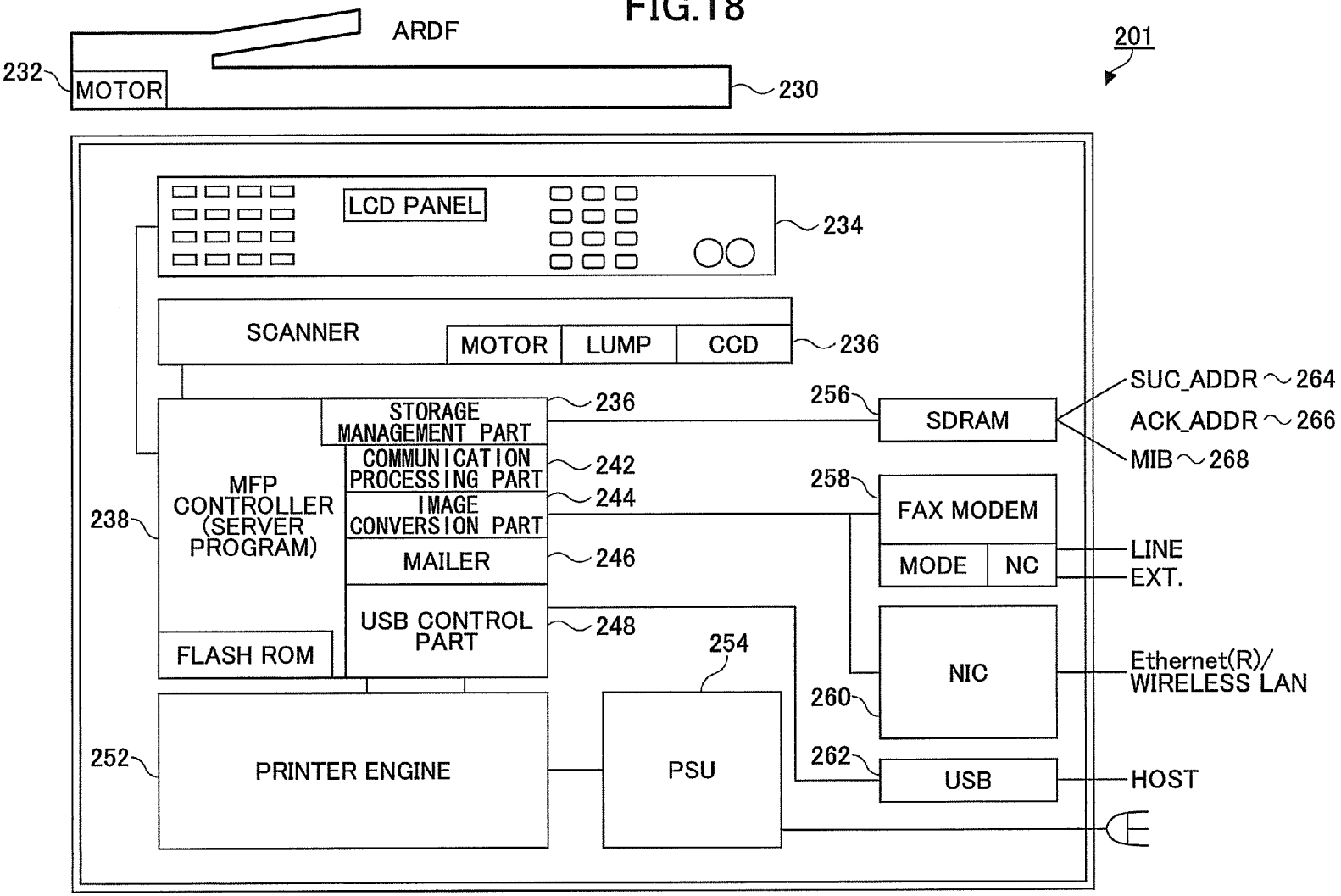
FIG. 18 is a functional block diagram of the image forming apparatus.

FIG. 18 is a functional block diagram of the image forming apparatus 201. The image forming apparatus 201 includes various functions such as a printer function, a copy function, a facsimile function, etc., and also includes an automatic reverse document feeder (ARDF) 230 for optically reading a document and an operation panel having an LCD panel. The ARDF 230 transfers a document set on a document table to a scanner 236, which optically reads the document, by driving a motor 232, and converts the document into digital data by driving a light irradiation optical system, a drive motor, a CCD, etc.

The image forming apparatus 201 includes a controller 238 and a printer engine 252 performing an image forming process. The controller 238 includes a CPU (not illustrated in the figure) for operating an operating system (hereinafter, referred to as an OS) such as UNIX (registered trademark), LINUX (registered trademark) and Windows (registered trademark) 200X server. Further, the controller 238 executes, under the above-mentioned OS, application programs described by programming language such as C, C++, JAVA (registered trademark) and Perl, and server programs such as Apache, Java Servlet, etc., to provide a part of a function of a Web server.

Further, the controller 238 is equipped with a storage management part 240, a communication processing part 242 and an image conversion part 244. The storage management part 240 performs an input-and-output management of a storage device 256 such as SDRAM, a hard disk drive unit, etc. The communication processing part 242 receives data from a facsimile modem 278 at a communication rate of 56 Kbps or 126 Kbps according to a protocol such as ITU-T recommendation T.6, and decodes the data using an encoding method such as a run length encoding, MR, MMR, etc., and codes the digital data for facsimile transmission from the image forming apparatus 201. Additionally, the communication processing part 242 manages a data transmission using IP protocol suite and TCP/IP or UDP/IP.

The communication processing part 242 receives a data transmission request from the application program contained in a controller 238, and creates an IP packet or a frame. Then, the communication processing part 242 transmits data to an Ethernet (registered trademark) or a wireless LAN from a network interface card (NIC) 260, and transmits received data to the application program. The communication processing part 242 supports a data connection protocol, such as PPP (Point-to-Point Protocol) and PPPoE (PPP on Ethernet (registered trademark)), in order to perform the processing mentioned above.

An image conversion part 244 converts data acquired by the image forming apparatus 201 into image data such as GIF, BMP, JPEG, JPEG2000, TIFF, and PNG, and creates PDL (Page Description Language) using the converted image data. The image conversion part 244 transfers the created PDL to a printer engine 252 to have the printer engine 252 perform an image forming process. A controller 238, to which a flash ROM 250 is mounted, manages setup data for starting an operation of the image forming apparatus 201 and color conversion data used for image formation. The controller 238 includes a USB control part 248 to manage a bus connection with a USB host (not illustrated in the figure) or the printer engine 252 through a USB connector 262. The USB control part 248 may support a USB protocol specified by IEEE802.15. A power supply unit (PSU) 254 mounted on the image forming apparatus 201 manages a power supply of the image forming apparatus 201.

The printer engine 252 performs an image forming operation using an inkjet method. The printer engine 252 includes the basic structure of the inkjet recording apparatus 1 illustrated in FIG. 1, such as the ink cartridge, the recording head 34, the waste liquid tank 90, etc. The printer engine 252 supports PJL (Printer Job Language) in order to perform a printing operation corresponding to a print request from an external the outside.

A storage apparatus 256 such as, for example, SDRAM manages a plurality of data sets. The data sets managed by the storage apparatus 256 are transmitter registration data (SUC_ADDR: source_Address) 264, acknowledge registration data (ACK_ADDR: Acknowledge_Address) 266, and MIB (Management Information Base) 268. The transmitter registration data 264 is previously setup by a user to specify whether the user receives a notification of reception of facsimile data. The transmitter registration data 264 is registered according to a format of a facsimile number. The acknowledgement registration data 266 registers an acknowledge address of the user concerned. The acknowledgement registration data 266 can be registered according to various formats such as, for example, an electronic mail address, a MAC address, an IP address (local domain specified with a private address/subnet mask), or a terminal name, which are used for transmitting electronic mail using a mailer 246. When using the MAC address and the IP address as the acknowledge registration data 266, it is desirable to mount a correspondence table of the terminal name or the user identification value and the MAC address or the IP address. If the network foundation is not TCP/OP but NETBIOS is used, a look-up table may be set as the acknowledge registration data 266. The terminal name, the IP address and the MAC address are registered in the look-up table by being related to each other.

MIB is a data set for registering network management information, which is constituted using MIB1 specified as RFC1156 or MIB2 specified by RFC1213. The MIB manages a status of an image forming apparatus to be managed using an object identification value (OID) and corresponding status data.

Each of the information processing apparatus 202 and the server 203 is a personal computer, a work station, or a server-dedicated information processing apparatus such as a blade server or a thin server. The information processing apparatus 202 transmits results of processing by application software to the image forming apparatus 201 through a printer driver to have the image forming apparatus 201 output the results of processing. If the server 203 is provided as a printer server, the server 203 receives a print request from the information processing apparatus 202 and sends an instruction of a print job to an appropriate image forming apparatus 201.

FIG. 19 is an example of a format of mail sent to a device manager (for example, the information processing apparatus 202) when an amount of waste liquid stored in the waste liquid tank 90 of the image forming apparatus 201 exceeds the warning waste liquid amount (close-to-full state). By sending a notification to the device manager using electronic mail, the device manager is prompted to replace the waste liquid tank.

It is desirable to have the memory element (storage means) of the waste liquid tank 90 store various kinds of information other than the information regarding identification of the waste liquid tank 90 and the information regarding an amount of waste liquid stored in the waste liquid tank 90. For example, it is desirable to store market information in the memory element of the waste liquid tank 90. The market information is used for recognizing an actual use method of a user on the market to assist development of future models. The market information may include, for example, a number of prints, a number of maintenance operations performed, etc.

Additionally, it is desirable to have the memory element store information (malfunction information) necessary for analyzing a malfunction or an abnormality. The malfunction information may include, for example, a number of paper jams, a number of prints when a paper jam occurs, a time of occurrence of a paper jam, a number of service calls that have been made, a time of occurrence of a service call, a number of times of running out ink, a number of prints that have been made at a time of running out ink, a time of occurrence of running out ink, etc.

A time of storing information in the memory element (storage means) of the waste liquid tank 90 is not limited to a specific time. Various sets of information may be stored in the memory element at a time of attaching the waste liquid tank 90 to the image forming apparatus 201 (inkjet recording apparatus 1), at a time when the waste liquid tank becomes close-to-full, at a time when the waste liquid tank becomes full, at a time of opening and closing the cover, or at a time turning a power on.

If various sets of information including the market information and the malfunction information are stored in the memory element (storage means) of the waste liquid tank 90, those sets of information can be efficiently collected and used by a supplier of the image forming apparatus.

The waste liquid management method performed by the above-mentioned image forming apparatus 201 (inkjet recording apparatus 1) can be performed by executing a program stored in a memory such as a ROM provided in the apparatus body of the image forming apparatus 201. The program for performing the waste liquid management method may be downloaded by the information processing apparatus 203 through the Internet and installed to the image forming apparatus 201. The program may be stored in a computer readable recording medium such as a CD-ROM, and the information processing apparatus 203 reads the program and installs the program to the image forming apparatus 201. Additionally, the waste liquid management method according to the present invention may be performed by a printer driver of the information processing apparatus 203. Further, the program for performing the waste liquid management method according to the present invention can be stored in a computer readable recording medium such as, for example, a CD-ROM which is readable by a processor of the image forming apparatus so that the image forming apparatus executes the program to perform the waste liquid management method.

The present invention is not limited to the specifically disclosed embodiments, and variations and modifications may be made without departing from the scope of the present invention.

The present application is based on Japanese priority application No. 2008-237420 filed on Sep. 17, 2008, the entire contents of which are hereby incorporated herein by reference.

What is claimed is:

1. An image forming apparatus comprising:

an image forming part configured and arranged to form an image by injecting a liquid;

a waste liquid tank detachably attached to said image forming apparatus and configured and arranged to store a waste liquid discharged from said image forming part, the waste liquid tank having a memory element to store identification information A and waste liquid amount information B of said liquid tank;

a memory unit that is different from said memory element incorporated in said waste liquid tank and stores identification information C and waste liquid amount information D of said waste liquid tank; and a control unit that manages information regarding said waste liquid tank, wherein each of the identification information A and the identification information C uniquely identifies said waste liquid tank, and each of the waste liquid amount information B and the waste liquid amount information D indicates an amount of liquid stored in said waste liquid tank; and wherein said control unit determines a current amount of the waste liquid currently retained in said waste liquid tank, when it is detected that said waste liquid tank is attached to said image forming apparatus, in accordance with a result of a comparison between the identification information A stored in said memory element of said waste liquid tank currently attached and the identification information C currently stored in said memory unit and a result of a comparison between the waste liquid amount B stored in said memory element of said waste liquid tank currently attached and the waste liquid amount D currently stored in said memory unit, and updates said current amount of the waste liquid in accordance with a subsequent operation of said image forming part, wherein said control unit determines that said waste liquid tank has not been replaced by a different waste liquid tank when the identification information A stored in said memory element of said waste liquid tank currently attached matches the identification information C previously acquired and currently stored in said memory unit, and said control unit selects a larger one of said waste liquid amount information B and said waste liquid amount information D and determines the larger one as said current amount of the waste liquid, wherein said control unit determines that said waste liquid tank has been replaced by a different waste liquid tank when the identification information A stored in said memory element of said waste liquid tank currently attached does not match the identification information C previously acquired and currently stored in said memory unit, and said control unit determines that said waste liquid tank currently attached is full when the waste liquid amount information B stored in said memory element of said waste liquid tank currently attached is not equal to zero.

2. The image forming apparatus as claimed in claim 1, wherein said control unit sets said current amount of the waste liquid to the larger one of said waste liquid amount information B and said waste liquid amount information D indicating a larger amount when said identification information A in said memory element matches said identification information C in said memory unit.

3. The image forming apparatus as claimed in claim 1, wherein said control unit sets said current amount of the waste liquid to said waste liquid amount information D when said identification information A in said memory element does not match said identification information C in said memory unit.

4. The image forming apparatus as claimed in claim 1, wherein said control unit stores information indicating said current amount of the waste liquid in said memory element as the waste liquid amount information B, and stores the information indicating said current amount of the waste liquid in said memory unit as the waste liquid amount information D.

5. The image forming apparatus as claimed in claim 1, wherein information indicating an allowable amount of the waste liquid regarding said waste liquid tank is stored in one of said memory element and said memory unit, and wherein said control unit stops an operation of said image forming part when said current amount of the waste liquid exceeds said allowable amount of the waste liquid after a maintenance of said image forming part is carried out.

6. The image forming apparatus as claimed in claim 5, wherein information indicating a warning amount of the waste liquid, which is smaller than said allowable amount of the waste liquid, is stored in one of said memory element and said memory unit, and, when said current amount of the waste liquid exceeds said warning amount of the waste liquid after a maintenance of said image forming part is carried out, said control unit notifies a user that said current amount of the waste liquid exceeds said warning amount of the waste liquid.

7. The image forming apparatus as claimed in claim 1, wherein information indicating an allowable amount of the waste liquid stored in said waste liquid tank is stored in one of said memory element and said memory unit, and said control unit computes a predicted amount of the waste liquid ejected in a maintenance operation of said image forming part before the maintenance operation is carried out, and stops an operation of said image forming part when a sum of said current amount of the waste liquid and said predicted amount of the waste liquid exceeds said allowable amount of the waste liquid.

8. The image forming apparatus as claimed in claim 7, wherein information indicating a warning amount of the waste liquid, which is smaller than said allowable amount of the waste liquid, is stored in one of said memory element and said memory unit, and said control unit computes a predicted amount of the waste liquid ejected in a maintenance operation of said image forming part before the maintenance operation is carried out and, when a sum of said current amount of the waste liquid and said predicted amount of the waste liquid exceeds said warning amount of the waste liquid, said control unit notifies a user that the sum of said current amount of the waste liquid and said predicted amount of the waste liquid exceeds said warning amount of the waste liquid.

9. The image forming apparatus as claimed in claim 1, wherein information indicating an allowable amount of the waste liquid stored in said waste liquid tank is stored in one of said memory element and said memory unit, and, when said current amount of the waste liquid exceeds said allowable amount of the waste liquid, said control unit notifies a user that said waste liquid tank attached is a used waste liquid tank.

10. The image forming apparatus as claimed in claim 6, wherein the notification to the user is performed by one of a display on an operation panel, a display on a printer driver, and a display according to electronic mail.

11. A waste liquid management method performed in an image forming apparatus including: an image forming part configured and arranged to form an image by injecting a liquid; a waste liquid tank detachably attached to said image forming apparatus and configured and arranged to store a waste liquid discharged from said image forming part, the waste liquid tank having a memory element to store identification information A and waste liquid amount information B of said liquid tank; and a memory unit that is different from said memory element incorporated in said waste liquid tank and stores identification information C and waste liquid amount information D of said waste liquid tank, wherein each of the identification information A and the identification information C uniquely identifies said waste liquid tank, and each of the waste liquid amount information B and the waste liquid amount information D indicates an amount of liquid stored in said waste liquid tank, the waste liquid management method comprising:

determining a current amount of the waste liquid currently retained in said waste liquid tank, when it is detected that said waste liquid tank is attached to said image forming apparatus, in accordance with a result of a comparison between the identification information A stored in said memory element of said waste liquid tank currently attached and the identification information C currently stored in said memory unit and a result of a comparison between the waste liquid amount B stored in said memory element of said waste liquid tank currently attached and the waste liquid amount D currently stored in said memory unit; and updating said current amount of the waste liquid in accordance with a subsequent operation of said image forming part, wherein said determining a current amount of the waste liquid currently retained in said waste liquid tank includes determining that said waste liquid tank has been replaced by a different waste liquid tank when the identification information A stored in said memory element of said waste liquid tank currently attached does not match the identification information C previously acquired and currently stored in said memory unit, and determining that said waste liquid tank has not been replaced by a different waste liquid tank when the identification information A stored in said memory element of said waste liquid tank currently attached matches the identification information C previously acquired and currently stored in said memory unit, and selecting a larger one of said waste liquid amount information B and said waste liquid amount information D and determining the larger one as said current amount of the waste liquid, wherein said determining a current amount of the waste liquid currently retained in said waste liquid tank includes determining that said waste liquid tank currently attached is full when the waste liquid amount information B stored in said memory element of said waste liquid tank currently attached is not equal to zero.

12. A nontransitory computer readable recording medium storing a program causing a computer of an image forming apparatus to perform a waste liquid management method, the image forming apparatus including: an image forming part configured and arranged to form an image by injecting a liquid; a waste liquid tank detachably attached to said image forming apparatus and configured and arranged to store a waste liquid discharged from said image forming part, the waste liquid tank having a memory element to store identification information A and waste liquid amount information B of said liquid tank; and a memory unit that is different from said memory element incorporated in said waste liquid container and stores identification information C and waste liquid amount information D of said waste liquid tank, wherein each of the identification information A and the identification information C uniquely identifies said waste liquid tank, and each of the waste liquid amount information B and the waste liquid amount information D indicates an amount of liquid stored in said waste liquid tank, the waste liquid management method comprising:

determining a current amount of the waste liquid currently retained in said waste liquid tank, when it is detected that said waste liquid tank is attached to said image forming apparatus, in accordance with a result of a comparison between the identification information A stored in said memory element of said waste liquid tank currently attached and the identification information C currently stored in said memory unit and a result of a comparison between the waste liquid amount B stored in said memory element of said waste liquid tank currently attached and the waste liquid amount D currently stored in said memory unit; and updating said current amount of the waste liquid in accordance with a subsequent operation of said image forming part, wherein said determining a current amount of the waste liquid currently retained in said waste liquid tank includes determining that said waste liquid tank has been replaced by a different waste liquid tank when the identification information A stored in said memory element of said waste liquid tank currently attached does not match the identification information C previously acquired and currently stored in said memory unit, and determining that said waste liquid tank has not been replaced by a different waste liquid tank when the identification information A stored in said memory element of said waste liquid tank currently attached matches the identification information C previously acquired and currently stored in said memory unit, and selecting a larger one of said waste liquid amount information B and said waste liquid amount information D and determining the larger one as said current amount of the waste liquid, wherein said determining a current amount of the waste liquid currently retained in said waste liquid tank includes determining that said waste liquid tank currently attached is full when the waste liquid amount information B stored in said memory element of said waste liquid tank currently attached is not equal to zero.

13. The image forming apparatus as claimed in claim 1, wherein said control part notifies a user that said waste liquid tank currently attached has been already in a full state.

* * * * *